US009963899B2

(12) United States Patent
Stokes, Sr.

(10) Patent No.: US 9,963,899 B2
(45) Date of Patent: May 8, 2018

(54) LIFT-SLIDE PARKING SYSTEM

(71) Applicant: Van Stokes, Sr., Delray Beach, FL (US)

(72) Inventor: Van Stokes, Sr., Delray Beach, FL (US)

( * ) Notice: Subject to any disclaimer, the term of this patent is extended or adjusted under 35 U.S.C. 154(b) by 0 days. days.

(21) Appl. No.: 15/432,980

(22) Filed: Feb. 15, 2017

(65) Prior Publication Data

US 2017/0234023 A1 Aug. 17, 2017

Related U.S. Application Data

(60) Provisional application No. 62/295,713, filed on Feb. 16, 2016.

(51) Int. Cl.
*E04H 6/18* (2006.01)
*E04H 6/30* (2006.01)
*E04H 6/12* (2006.01)

(52) U.S. Cl.
CPC ..... *E04H 6/307* (2013.01); *E04H 6/12* (2013.01); *E04H 6/18* (2013.01); *E04H 6/185* (2013.01)

(58) Field of Classification Search
CPC .. E04H 6/12; E04H 6/18; E04H 6/185; E04H 6/307; E04H 6/34
See application file for complete search history.

(56) References Cited

U.S. PATENT DOCUMENTS

| | | | | |
|---|---|---|---|---|
| 9,890,549 | B2 * | 2/2018 | Gambarotta | E04H 6/12 |
| 2013/0322993 | A1 * | 12/2013 | Farid | E04H 6/225 414/231 |
| 2016/0251867 | A1 * | 9/2016 | Cifelli | E04H 6/185 414/235 |

FOREIGN PATENT DOCUMENTS

| | | | | |
|---|---|---|---|---|
| DE | 202011000081 | U9 * | 1/2012 | E04H 6/185 |
| DE | 212014000139 | U1 * | 1/2016 | E04H 6/06 |
| EP | 3064675 | A1 * | 9/2016 | E04H 6/185 |
| WO | WO-02097220 | A1 * | 12/2002 | E04H 6/12 |
| WO | WO-03100197 | A1 * | 12/2003 | B66B 9/04 |
| WO | WO-2014198166 | A1 * | 12/2014 | E04H 6/06 |
| WO | WO-2016026274 | A1 * | 2/2016 | B66F 9/07 |

* cited by examiner

*Primary Examiner* — Kaitlin S Joerger

(74) *Attorney, Agent, or Firm* — Timothy X. Gibson, Esq.; Gibson & Dernier LLP

(57) ABSTRACT

Lift and slide parking systems employ a plurality of novel trolley apparatus. Each trolley includes a rectangular frame from which a platform may be raised and lowered via cables coupled to lifting bars positioned at each of four corners of the platform. On one side of the frame a slide rail and trolley sliding assembly includes hydraulic cylinders coupled with cables routed through sheaves arranged to enable movement of the trolley horizontally a necessary distance. The slide rail may include grooves in which a sliding block may be slidably retained. On the side opposite the slide rail is a lift rail and platform lift assembly which includes a hydraulic cylinder coupled with one or more belts routed through rollers to a lifting block coupled with cables routed through sheaves and coupled to lifting bars arranged to enable vertical movement of the platform. The lift rail may include grooves in which a cylinder block and lift block are slidably retained. A sliding roller at each corner of the frame is positioned to engage in tracks attached to the superstructure which run the width of the parking system.

20 Claims, 26 Drawing Sheets

LIFT-SLIDE PARKING SYSTEM

CROSS-REFERENCE TO RELATED APPLICATIONS

This application claims the benefit of U.S. Provisional Patent Application No. 62/295,713 filed Feb. 16, 2016, the entirety of which is incorporated herein by reference.

FIELD OF THE INVENTION

The invention relates to lifts for automobiles and in particular, lift-slide parking apparatus for automobiles.

BACKGROUND

Mechanical parking system are used where space is restricted or at a premium. The length and depth of the ground space and the height available to the system are the major factors in determining the number of vehicles that can be parked for each type of system. Just as with conventional parking systems, mechanical parking systems have space not used for parking. In the conventional system the space is needed for driving aisles, ramps, stairways and passenger elevators along with the additional space needed on each side of every parked vehicle to allow the doors to open and passengers to enter and exit. In conventional parking garages extra height is required between the levels to allow for the thickness of the floor and supporting beams, pedestrian traffic and overhead lighting. Mechanical parking garages do not require driving aisles, ramps, stairways, passenger elevators, floors, overhead lighting or pedestrian traffic. The cars can be stored much closer together because the doors are never opened in the storage area. There are no ceilings or floors required and the vertical space between the stored vehicles is kept to a minimum. Mechanical parking garages do, however, require a certain amount of equipment to perform their operation. The style and configuration of this equipment helps to determine the overall space-saving characteristic of the mechanical parking garage.

SUMMARY OF THE INVENTION

There is a need in the art for a mechanical automobile lift assembly that conserves space. Provided herein are embodiments of a lift and slide parking apparatus including novel lifting and sliding apparatus. The systems described herein reduce the amount of space required for the equipment and provide more parking spaces per cubic foot than currently available mechanical parking systems.

The lift and slide-type parking system is the most commonly used type of mechanical parking system in the world today. As the name implies this type of parking system employs a plurality of trolleys, some of which can lift a vehicle to a storage area and slide horizontally to allow access to other stored vehicles. The maximum height of common lift and slide-type parking systems is controlled by the type and configuration of the equipment used to achieve the lift and horizontal movement. Because mechanical parking systems are generally used where space is at a premium, the equipment used for the system should occupy the smallest space possible.

Currently available lift and slide-type parking systems have a number of shortcomings. The space occupied by the mechanical components of the system needs to be minimized and configured so that the overall space occupied by the system is kept to a minimum. Because electric motors are generally used for the lifting and lowering of the vehicles as well as the horizontal sliding there must be high-voltage electrical wiring installed throughout the system. In addition each, motor requires some form of relay or contactor to control it. To achieve the desired result, all of the electric motors need to be operated in the forward and reverse direction, requiring additional circuitry and relays. Each electric motor must be connected with a gearbox and an electric brake, requiring additional wiring and circuitry to release the electric brake. All of the aforementioned electrical wiring to the lifting motors and the horizontal slide motors located in the trolleys must be made flexible and connected in such a manner to allow the trolley to slide while not interfering with adjacent trolleys. In most cases the electric motor, gearbox, brake, used for lifting and lowering, are connected to a cable drum to wind the lifting cables unto the drum while the platform is being lifted. Because the platform that is used to hold the vehicle must be lifted by the four corners this requires four lifting cables that must be wound unto the lifting drum. The diameter of the lifting drum must be sized in relation to the size of the cable being use to lift and lower the platform. The width of the lifting drum must be sufficient to allow all four cables to wind completely when the platform is in the raised position. The combination motor, gearbox, brake, lifting drum, along with its electrical connection box, must be positioned somewhere on the trolley where it does not interfere with the space required by the parked vehicle. Because of the physical size of these items additional space is required in the parking structure. In most cases these items are placed to the front or rear of the trolley requiring additional space in the parking structure for the enlarged trolley.

Additionally, the lifting height of the trolley is restricted by the amount of cable that can be wound unto the lifting drum. As the lifting distance is increased the cable drum size increases significantly. Also, as the trolleys are placed higher in a structure the speed of the lifting operation must be increased. To increase the speed of the electric motors used for the lifting operation it is necessary to use larger capacity electric motors, gearboxes, brakes, electrical wiring, control boxes, switches, relays, etc. on every trolley. The larger electric motor, gearboxes, brakes, etc. require more space and increase the overall size of the parking structure.

In some cases in lift and slide-type systems, hydraulic cylinders are used for lifting and lowering. The trolleys generally consist of a rectangular frame and the hydraulic cylinder is normally mounted on one of the long sides of the trolley frame along with its block, multiplier sheaves and direction changing sheaves. Because of the limited length of the trolley the hydraulic cylinder cannot directly lift the platform and the lifting cables must be reeved to achieve the desired lift. This arrangement works at the lower levels with a minimum amount of reeving because the hydraulic equipment will occupy a smaller amount of space. Generally 3:1 is considered the ideal lifting ratio. This keeps the equipment down to a manageable size. At higher levels, where the amount of reeving and the number of multiplier sheaves required must increase, this arrangement decreases the available space for the hydraulic cylinder to operate. Also, the additional reeving requires the diameter of the hydraulic cylinder to increase because of the additional load. Thus, the amount of space available is significantly decreased and the overall width is increased, both of which are undesirable conditions.

It is also common practice to have different size trolleys for each vertical level each containing a different size lifting mechanism. This increases the number of parts that must be manufactured as the system height is increased. Also, the overall footprint of the entire system is determined by the largest trolley required. Each of the trolleys that are required to move horizontally must have a mechanical drive connected to an additional motor, gearbox, brake and electrical controls for that operation. These components also occupy a certain amount of space that cannot be used for vehicle storage which increases the overall size of the parking system.

Also in currently available lift and slide-type parking lift systems, when the trolleys are moved horizontally, because the platforms are suspended by lifting cables, they have a tendency to swing from the cables. To minimize this effect the platforms are raised to the trolley level where the swinging can be minimized by the trolley framework. This requires the trolley framework to be larger than the parking space needed for the vehicle. This too significantly increases the overall space required for the entire system.

In one or more embodiment lift and slide systems described herein operate hydraulically and do not require any distribution of high-voltage electrical circuits. The disclosed systems have a number of unique features that decrease the overall space required allow permit much higher lifting than currently available lift and slide-type parking systems, while occupying a smaller space for the lifting equipment. The disclosed systems permit vehicles to be stored much closer together, providing more parking spaces per cubic foot. This is particularly advantageous in reducing the overall size of a given parking structure. The systems disclosed herein employ trolleys having the same equipment and allow much faster operation of the lifting and sliding functions. Systems disclosed herein also may include safety features.

In general a configuration for a system in accordance with the present disclosure includes a given number of rows and columns of trolleys. Each of the trolleys includes a frame and a platform for supporting vehicles, wherein the platform can be lowered from and raised toward the frame, and is slidable horizontally. In some embodiments, the top row of the system includes one more trolley than the rows below the top row, except for the bottom row, which does not form part of the system. For example, a configuration could include four trolleys in the uppermost row and three trolleys in each row below. This results in an empty space in each of the rows below the uppermost row. In other embodiments, the top row does not include any trolleys, only platforms that may be lowered and raised. In still further embodiments, the top row may have a blank space to permit positioning the vehicles. For example, if a support column forms an obstruction the uppermost row apparatus must be able to lower the car in a space that will clear the column so it will move the car horizontally past the column before lowering. In yet further embodiments, trolleys in the uppermost row may be fixed in position, i.e., not slidable in a horizontal direction, or may be horizontally slidable in embodiments in which the structure requires maneuvering vehicles in the uppermost row.

In one or more embodiments the trolleys in the rows beneath the uppermost row are all slidable horizontally. The trolleys are operable to each independently move horizontally a distance adequate to permit the creation of a longitudinal path for a selected platform to rise or descend. In some embodiments the trolleys are operable to be slidable a distance of at least the width of one trolley. In some embodiments, the platforms are operable to slide a distance greater than the width of one trolley. For example in cases in which the structure includes a support column or other obstruction that must be bypassed, a trolley may be configured and operable to move horizontally a few inches or feet greater than the width of one complete trolley, depending on the requirements posed by the particular structure. The vehicles at the ground level may for example rest on platforms which have the ability to move or be moved horizontally, using known apparatus such as but not limited to carts, dollies, etc. Therefore in each row below the uppermost row there is an open or "blank" space which allows the system to be configured and to operate so that any car in the system can be individually parked or retrieved by aligning the blank spaces below the platform of the vehicle to be retrieved and lowering the platform bearing the vehicle to ground level to a space or location that is convenient for the vehicle to enter or leave the parking system.

Novel lift and slide parking systems as disclosed herein employ a plurality of novel trolley apparatus. Each trolley includes a rectangular frame from which a platform may be raised and lowered via cables coupled to lifting bars positioned at each of four corners of the platform. On one side of the frame a trolley sliding assembly includes hydraulic cylinders coupled with cables routed through sheaves arranged to enable movement of the trolley horizontally a necessary distance. In some instances herein the frame member on the side of the trolley sliding assembly is referred to as a slide rail. The slide rail may include grooves in which a sliding block may be slidably retained. On the side opposite the slide rail is a platform lift assembly which includes a hydraulic cylinder coupled with one or more belts or chains routed through rollers such as belt or chain rollers to a lifting block coupled with cables routed through sheaves and coupled to lifting bars arranged to enable vertical movement of the platform. In some instances the frame member on the side of the platform lifting assembly is referred to as the lift rail. The lift rail may include grooves in which a cylinder block and lift block are slidably retained. The lift rail and slide rail are connected to each other at each end by support members and the frame may be held secure with diagonal members such as but not limited to tensioning cables. A sliding roller at each corner of the frame is positioned to engage in tracks attached to the superstructure which run the width of the parking system. The superstructure may be any structure known in the art for employing a lift and slide-type parking apparatus.

Actuation of the lifting assembly causes the platform to rise or descend. Actuation of the sliding assembly causes the trolley to slide in a given direction.

The lifting mechanism may further include a safety latch assembly to retain the cables in one or more fixed positions, a latch release mechanism, and may be electrically coupled to one or more switches for operating the lift.

In accordance with one or more embodiments a lift-slide parking system includes a plurality of trolleys positioned within a superstructure, the superstructure having a front side and a rear side and a plurality of tracks oriented horizontally on the front and rear side, each of the trolleys including a rectangular frame and a rectangular platform depending from the frame, wherein the frame includes a first side having a lift rail having a platform lifting apparatus, a second, opposite side having a slide rail including a trolley sliding apparatus, and first and second ends disposed between the first side and opposite side, and further including at least one roller extending from each of the first and second end of the frame and oriented in axial alignment with the first and second ends of the frame, wherein the rollers at each end of the trolley are sized and configured to engage respective tracks oriented in axial alignment with the first and second ends of the frame, wherein the platform lifting apparatus includes a lift hydraulic cylinder coupled to the lift rail disposed in axial alignment with the first side coupled to a cylinder block, the cylinder block having a cylinder block sheave slidably disposed in a cylinder block channel formed in the lift rail in axial alignment with the cylinder, wherein the cylinder block is coupled via a belt to a first end of a lifting block slidably disposed in a lifting block channel formed in the lift rail side and axially aligned with and above the cylinder block channel, wherein the belt is routed over at least one roller positioned in a first corner of the frame in axial alignment with the lift rail, wherein the belt is anchored to the frame proximal the first corner and routed around the cylinder block sheave, wherein the lifting block includes a plurality of lift cables extending from a second end thereof, wherein each of the plurality of cables extend and are coupled to respective lift bars coupled to respective corners of the platform; and wherein the trolley sliding apparatus includes at least two slide hydraulic cylinders coupled to the slide rail and disposed in axial alignment with the second side of the frame, wherein a first of the slide hydraulic cylinders is coupled to a first slide cable, wherein the first slide cable is anchored at a first end to the frame and coupled at a second end to one of the tracks at a first position, and a second of the slide hydraulic cylinders is coupled to a second slide cable, wherein the second slide cable is anchored at a first end to the frame and coupled at a second end to the same track as the first slide cable at a second position, wherein actuation of one of the slide hydraulic cylinders is operable to pull the slide cable coupled thereto causing the trolley to move in a first direction in axial alignment with the track, and actuation of the other of the slide hydraulic cylinders is operable to pull the slide cable coupled thereto causing the trolley to move in a second, opposite direction.

The lift block may include a lift block sheave. The trolley may include a ratio multiplication sheave axially aligned with the lift rail proximal a second corner positioned opposite the first corner of the frame.

In accordance with one or more embodiments of the system a first of the plurality of lift cables is routed from the lift block around the ratio multiplication sheave, back to and around the lift block sheave and over a first lift vertical directional sheave positioned proximate the ratio multiplication sheave, and routed downward to terminate at a first of the respective lift bars.

In accordance with one or more embodiments of the system a second of the plurality of lift cables is routed from the lift block around the ratio multiplication sheave, back to and around the lift block sheave, then around a second lift vertical directional sheave positioned proximate the ratio multiplication sheave, and routed back to and over a lift vertical directional sheave positioned proximate the second corner and routed downward to terminate at a second of the respective lift bars. In accordance with one or more embodiments the second vertical directional sheave is mounted in axial alignment with the first vertical direction sheave.

In accordance with one or more embodiments of the system a third of the plurality of lift cables is routed from the lift block around the ratio multiplication sheave, back to and around the lift block sheave and around a first lift vertical directional sheave positioned proximate to and in axial alignment with the ratio multiplication sheave, and routed along the lift rail to and around a first lift horizontal directional sheave positioned proximate the second corner, and routed over a third vertical directional sheave mounted proximate a third corner of the frame diagonally opposite the first corner and routed downward to terminate at a third of the plurality of lift bars.

In accordance with one or more embodiments of the system a fourth of the plurality of lift cables is routed from the lift block around the ratio multiplication sheave, back to and around the lift block sheave and around a second lift horizontal directional sheave positioned proximate the first corner, then routed over a fourth vertical directional sheave mounted proximate a fourth corner of the frame diagonally opposite the second corner and routed downward to terminate at a fourth of the plurality of lift bars.

In accordance with some embodiments a trolley for a lift-slide parking system is disclosed, the trolley including a rectangular frame and a rectangular platform depending from the frame, wherein the frame includes a first side having a lift rail including a platform lifting apparatus, a second, opposite side including a slide rail including a trolley sliding apparatus, and first and second ends disposed between the first side and opposite side, and further including at least one roller extending from each of the first and second end of the frame and oriented in axial alignment with the first and second ends of the frame, wherein the rollers at each end of the trolley are sized and configured to engage respective tracks oriented in axial alignment with the first and second ends of the frame, wherein the tracks are fixed to a superstructure of a lift-slide parking system, wherein the platform lifting apparatus includes a lift hydraulic cylinder coupled to the lift rail disposed in axial alignment with the first side coupled to a cylinder block having a cylinder block sheave slidably disposed in a cylinder block channel formed in the lift rail in axial alignment with the cylinder, wherein the cylinder block is coupled via a belt to a first end of a lifting block slidably disposed in a lifting block channel formed in the lift rail side and axially aligned with and above the cylinder block channel, wherein the belt is routed over at least one roller positioned in a first corner of the frame in axial alignment with the lift rail, wherein the belt is anchored to the frame proximal the first corner and routed around the cylinder block sheave, wherein the lifting block includes a plurality of lift cables extending from a second end thereof along the lifting block channel, wherein each of the plurality of cables extend and are coupled to respective lift bars coupled to respective corners of the platform. The trolley sliding apparatus includes at least two slide hydraulic cylinders coupled to the slide rail and disposed in axial alignment with the second side of the frame, wherein a first of the slide hydraulic cylinders is coupled to a first slide cable, wherein the first slide cable is anchored at a first end to the frame and couplable at a second end to one of the tracks at a first position, and a second of the slide hydraulic cylinders is coupled to a second slide cable, wherein the second slide cable is anchored at a first end to the frame and couplable at a second end to the same track as the first slide cable at a second position wherein when the first and second slide cables are coupled to the track. Actuation of one of the slide hydraulic cylinders is operable to pull the slide cable coupled thereto causing the trolley to move in a first direction in axial alignment with the track, and actuation of the other of the slide hydraulic cylinders is operable to pull the slide cable coupled thereto causing the trolley to move in a second, opposite direction.

The lift block may include a lift block sheave, and a ratio multiplication sheave axially aligned with the lift rail proximal a second corner positioned opposite the first corner of the frame.

In accordance with one or more embodiments of the trolley a first of the plurality of lift cables is routed from the lift block around the ratio multiplication sheave, back to and around the lift block sheave and over a first lift vertical directional sheave positioned proximate the ratio multiplication sheave, and routed downward to terminate at a first of the respective lift bars.

In accordance with one or more embodiments of the trolley a second of the plurality of lift cables is routed from the lift block around the ratio multiplication sheave, back to and around the lift block sheave, then around a second lift vertical directional sheave positioned proximate the ratio multiplication sheave, and routed back to and over a lift vertical directional sheave positioned proximate the second corner and routed downward to terminate at a second of the respective lift bars. In accordance with one or more embodiments the second vertical directional sheave is mounted in axial alignment with the first vertical direction sheave.

In accordance with one or more embodiments of the trolley a third of the plurality of lift cables is routed from the lift block around the ratio multiplication sheave, back to and around the lift block sheave and around a first lift vertical directional sheave positioned proximate to and in axial alignment with the ratio multiplication sheave, and routed along the lift rail to and around a first lift horizontal directional sheave positioned proximate the second corner, and routed over a third vertical directional sheave mounted proximate a third corner of the frame diagonally opposite the first corner and routed downward to terminate at a third of the plurality of lift bars.

In accordance with one or more embodiments of the trolley a fourth of the plurality of lift cables is routed from the lift block around the ratio multiplication sheave, back to and around the lift block sheave and around a second lift horizontal directional sheave positioned proximate the first corner, then routed over a fourth vertical directional sheave mounted proximate a fourth corner of the frame diagonally opposite the second corner and routed downward to terminate at a fourth of the plurality of lift bars.

In certain embodiments the distance from a floor of the platform to a bottom side of the lift rail when the platform is in a fully raised position is adequate to permit passage of a widest width of a vehicle parked on the platform. In still further embodiments the distance from a floor of the platform to a bottom side of the slide rail when the platform is in a fully raised position is adequate to permit passage of a widest width of a vehicle parked on the platform.

In still further embodiments the trolley includes a safety latch removably couplable to the lift block, wherein the safety latch is mounted proximal the at least one roller in the first corner of the frame. The safety latch may include a pawl operable to engage the first end of the lift block.

The platform may include a drive on ramp at an entrance end, a wheel stop or drive-on ramp at an opposite end of the platform and wheel runways extending therebetween. It will be recognized that in some cases it is desirable to be able to drive across a platform on the floor. For example, in some cases the system may be designed for cars to drive in from one end and drive out of the other. In such cases a platform includes ramps at opposite ends. The runways include curbs at the periphery. The runway curbs are used to direct the vehicles onto the platform straightaway and are sized, dimensioned and positioned so that they keep an automobile basically centered on the platform. The curbs are of such a width that the mirrors and other parts of the car that extend beyond the outside walls of the tire do not extend beyond the platform edge. This allows placement of adjacent trolleys close together, conserving space from side to side, without hitting the mirrors of adjacent cars.

In one embodiment the drive-on ramp is disposed at an entrance end of the ramp and may have sloped front and back ends so that as a car is driven onto the platform and onto the runway treads the sloped back end serves as a block to prevent the car rolling off the entrance end of the platform. If a wheel stop is used at the platform end opposite the entrance end it is dimensioned to prevent the car rolling off the end opposite the entrance end of the platform.

The thickness of the platform employed in some embodiments is from about 2 mm to about 10 mm. This allows the wheels of the vehicle to be parked on the very bottom of the platform. Employing a minimal platform thickness, such as 2 mm, permits a reduction of space between the raised platform and a trolley positioned beneath the platform.

BRIEF DESCRIPTION OF THE DRAWINGS

For the purposes of illustration, there are forms shown in the drawings that are presently preferred, it being understood, however, that the invention is not limited to the precise arrangements and instrumentalities shown.

FIG. 9 A is an enlarged view of detail A of FIG. 9 in accordance with an embodiment of the present disclosure;

DETAILED DESCRIPTION OF THE INVENTION

Figure 1:
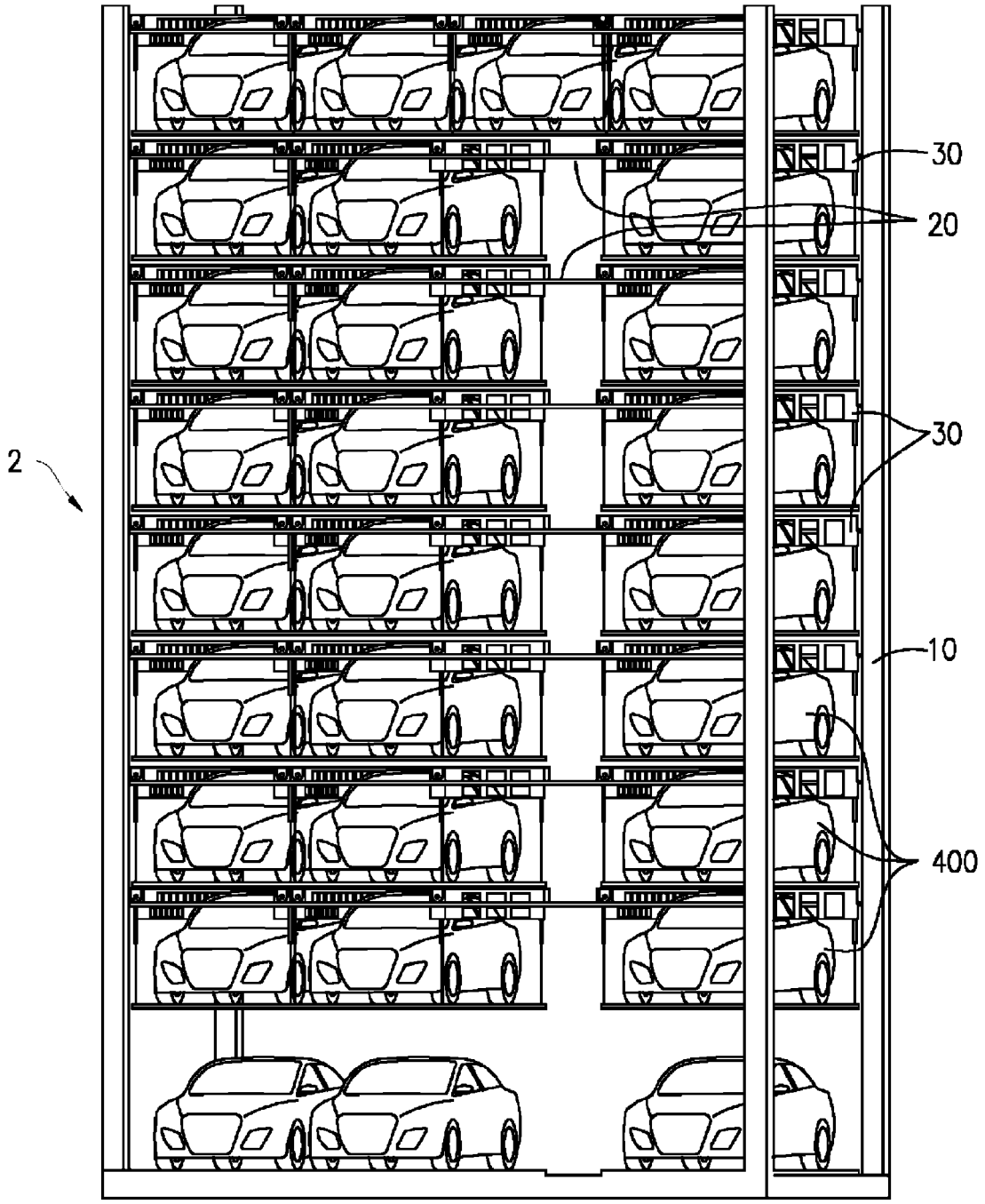
FIG. 1 is a front perspective view of a parking system in accordance with an embodiment of the present disclosure in which support columns and a simulated floor are shown for descriptive purposes only.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, the terms belts, chains, cables, wire ropes, bands, etc. may be used interchangeably. For example, as will be apparent to those having ordinary skill in the art, in some instances use of a chain or belt may be preferable to the use of a cable, or vice versa. As used herein the term "rectangular" has its ordinary meaning and includes squares.

Embodiments of the present invention will now be described with reference to the FIGs. With reference to FIG. 1, in an exemplary embodiment a general configuration of a 4-across, 9-high lift and slide system 2 in accordance with the present disclosure is shown. A plurality of tracks 20 are horizontally mounted to superstructure 10, and a plurality of trolleys 30 are slidably engaged with tracks 20. The layout shown is generally referred to as a 4x+8 Lift-Slide. The "4" indicates four columns of vehicles stacked vertically (occupies 4 parking spaces on the ground) and the +8 indicates there are 8 rows or levels above the ground space (including the ground space makes it a 9-high lift and slide system. There are times when some of the parking spaces can be below the entrance (usually ground) level. In such cases, using the configuration shown, the designation might be 4x (−2+8), indicating four columns with two rows below the entrance level and eight rows above the entrance level for a total of eleven rows (levels) of parking including the entrance level. In the configuration shown four cars 400 are in the uppermost row and three cars 400 are in each row below. This results in an empty space in each of the rows below the uppermost row. The trolleys 30 for the cars in the uppermost row may be fixed in position so that they are not movable horizontally. In some embodiments the top row does not include trolleys, only platforms 300 that may be lowered and raised. The trolleys 30 below the uppermost row are movable horizontally a distance adequate to permit the creation of a longitudinal path for a selected platform 300 to rise or descend. In some embodiments the trolleys 30 are operable to be slidable a distance of at least the width of one trolley. In some embodiments, the trolleys 30 are operable to slide a distance greater than the width of one trolley. The vehicles at the ground level are resting on platforms which are movable horizontally using other devices known in the art. Therefore in each row below the uppermost row there is a blank space which allows the system to be configured so that any car 400 in the system 2 can be individually parked or retrieved by aligning the blank spaces below the desired vehicle.

The superstructure 10 may be any structure known in the art for employing a lift and slide-type parking apparatus.

Figure 1A:
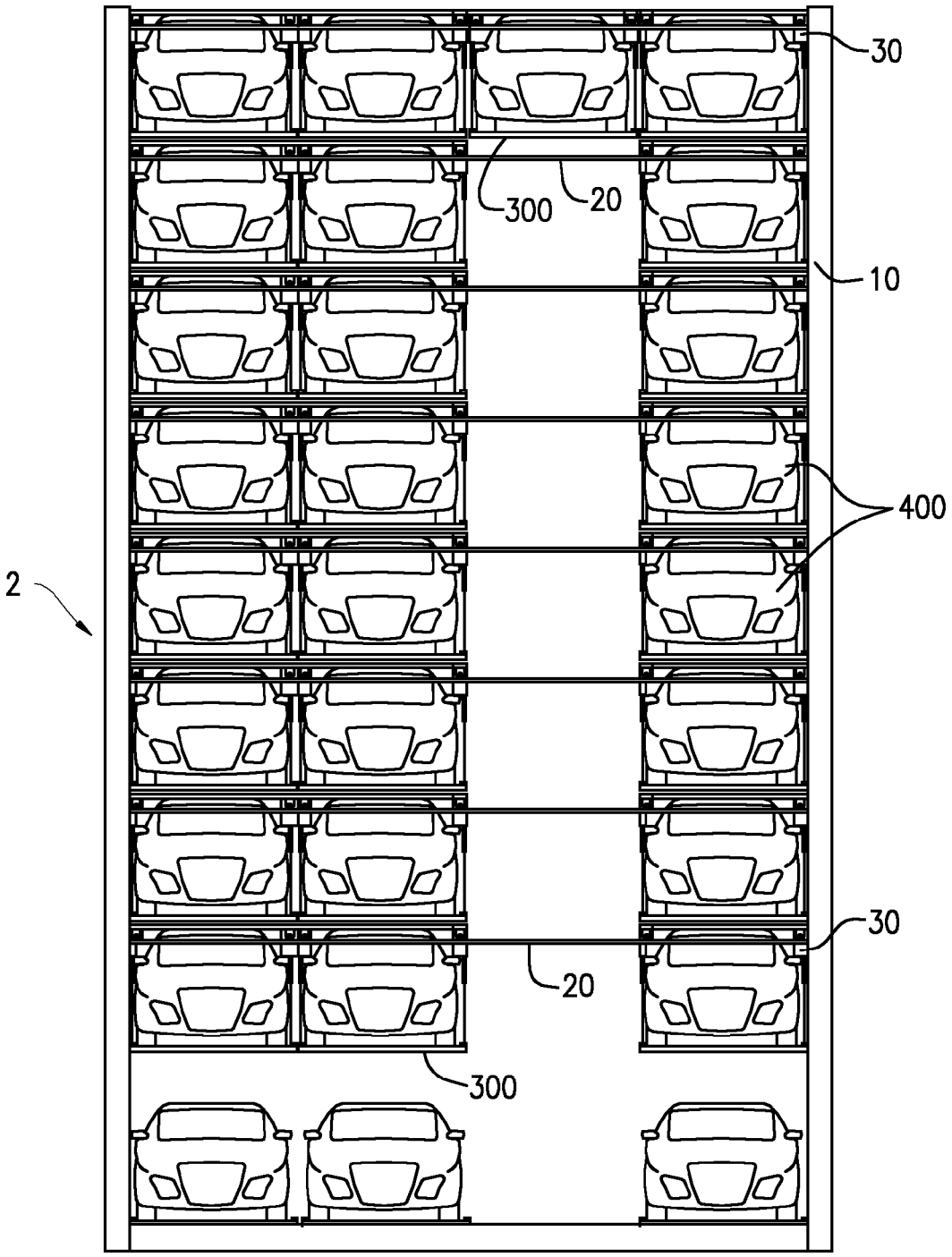
FIG. 1A is a front view of the system of FIG. 1 with all blank spaces aligned below a certain position in accordance with an embodiment of the present disclosure.

Now referring to FIG. 1A, a front view of the system of FIG. 1 shows all of the blank spaces aligned below position "three" (the top of third row from the left). In order to retrieve the car 400 in the second row from the top, second column from the left, all of the vehicles below that position in the second column from the left must move or "slide" into the blank space in the third column from the left in order to open a column of blank spaces below the desired vehicle. All of the trolleys 30, which contain the parked vehicles, can move independently. Therefore in this instance if it were desired to remove a vehicle in the first column from the left the blocking vehicles below it as well as the adjacent vehicles in the second column from the left would be slid to create a column of blank spaces below the desired vehicle in the first column from the left.

Figure 2:
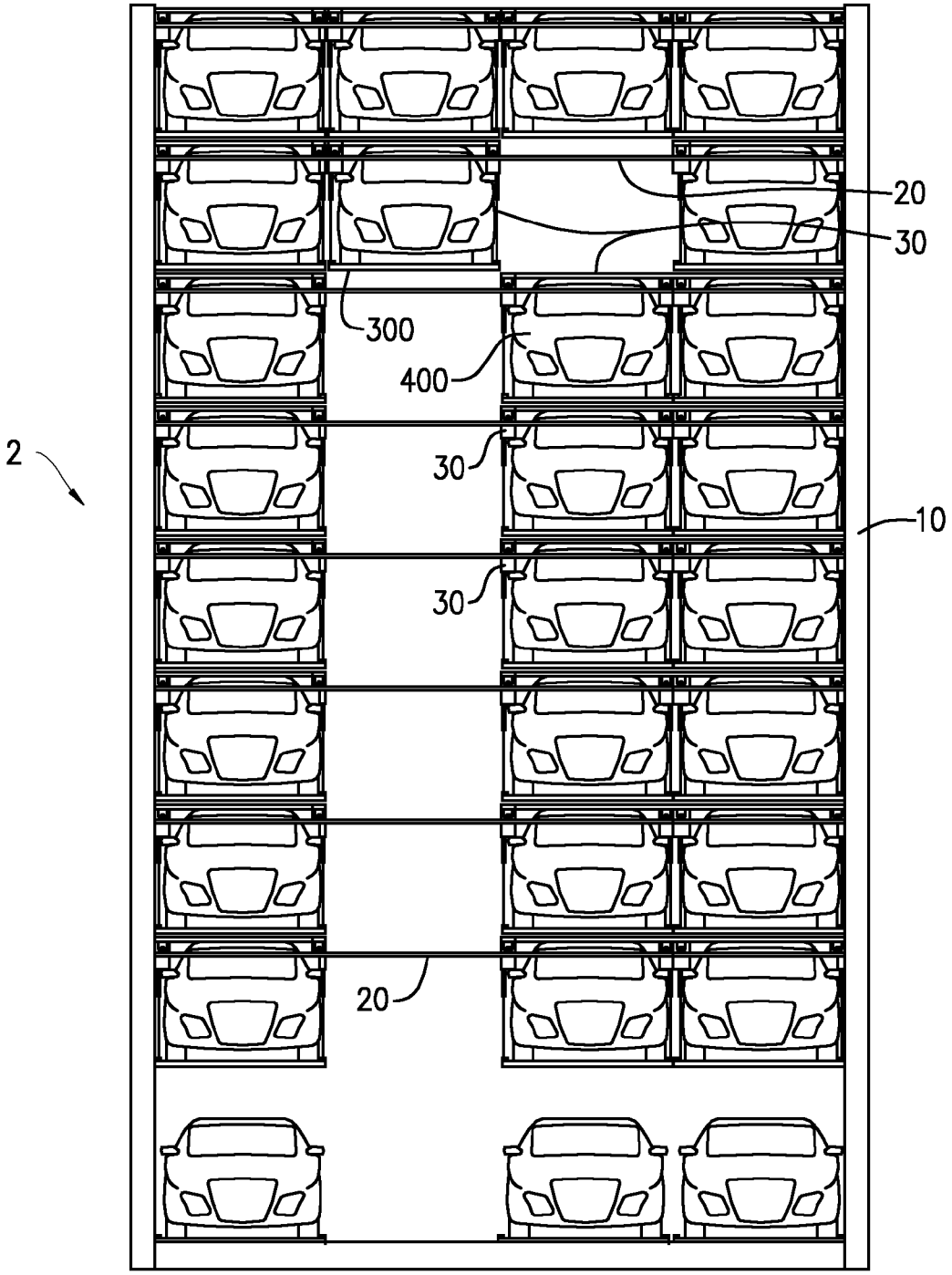
FIG. 2 is a front view of the system of FIG. 1 with a selected vehicle positioned as shown in accordance with an embodiment of the present disclosure.
Figure 3:
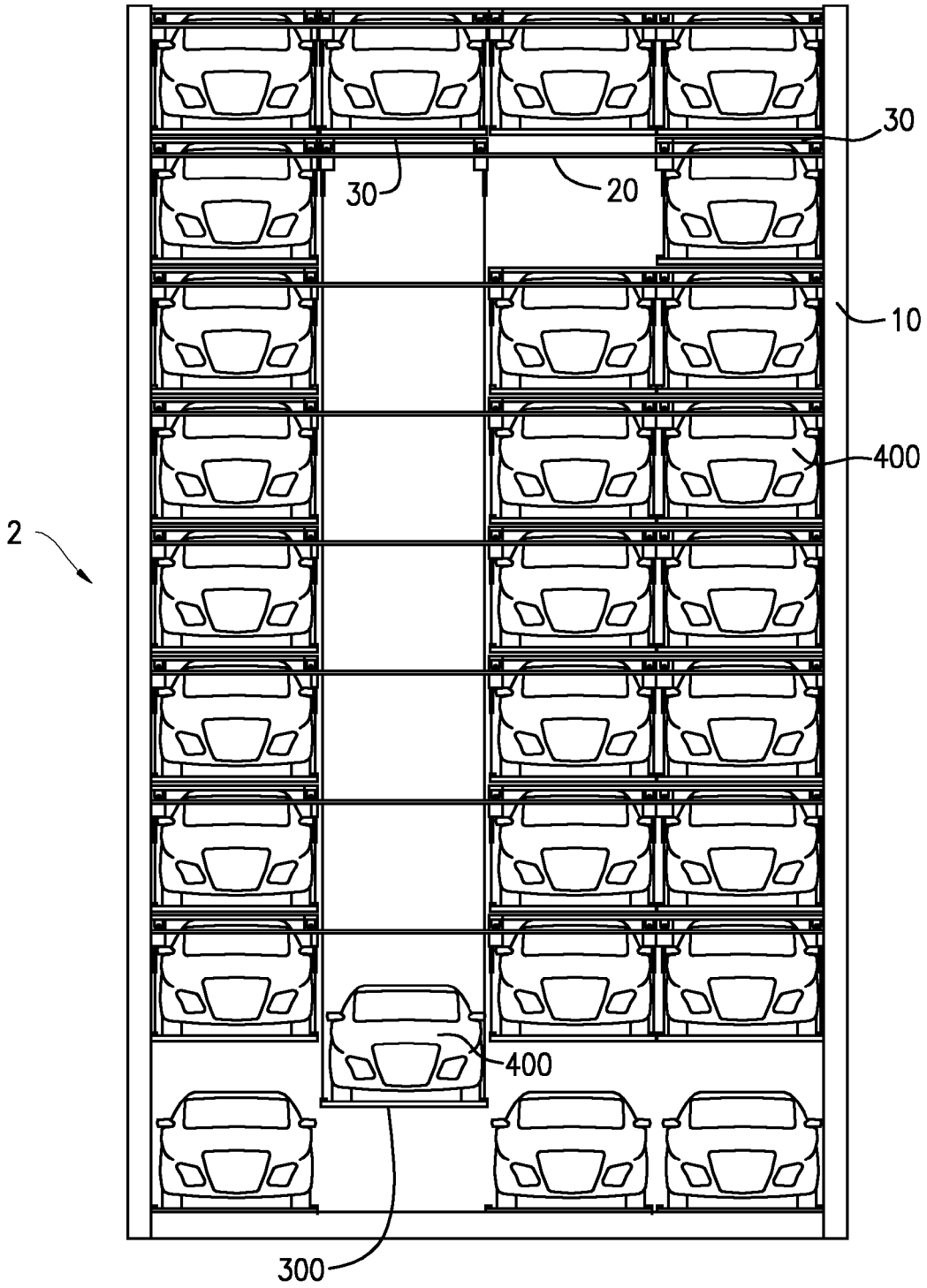
FIG. 3 is a front view of the system of FIG. 1 with a selected vehicle positioned as shown in accordance with an embodiment of the present disclosure.

Now referring to FIG. 2, it is illustrated that the trolleys 30 below car 400 in the second row from the top, second column from the left have slid horizontally one space into the proper position to allow the platform 300 engaged to the trolley 30 in that position to be lowered. With further reference to FIG. 3, the platform 300 of the trolley 30 in the second row from the top, second column from the left is shown being lowered to the ground level. Once the car 400 is lowered and driven from the platform 300, the platform 300 can remain on the ground to accept a new vehicle or be raised back to its storage position to allow other vehicles to be retrieved.

Figure 4:
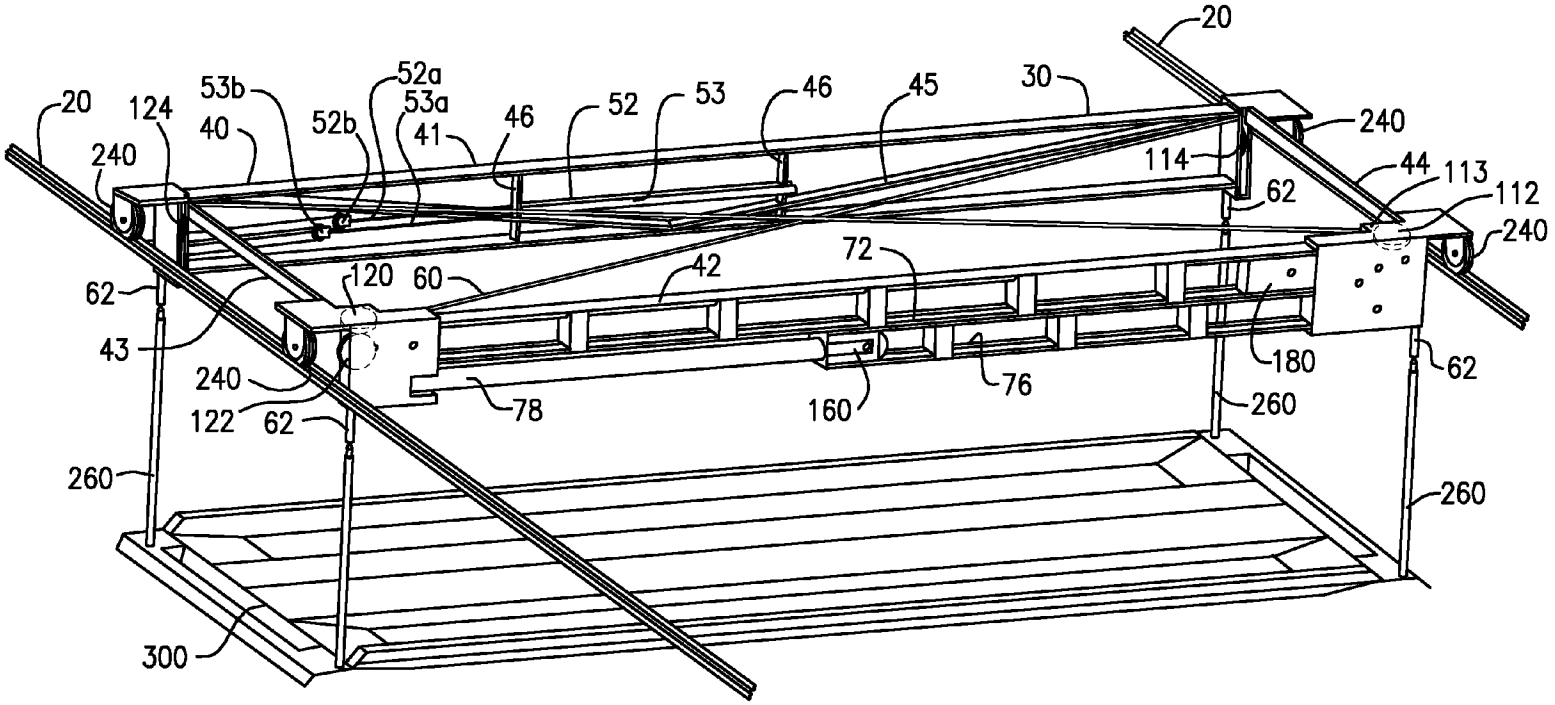
FIG. 4 is an elevated perspective view of a trolley in accordance with an embodiment of the present disclosure.

Now referring to FIG. 4, a trolley 30 includes a rectangular frame 40 from which a platform 300 may be raised and lowered via cables coupled to lifting bars 260 positioned at each of four corners of the platform 300. On one side of the frame 40 a slide rail 41 includes slide hydraulic cylinders 52, 53 mounted thereon, for example, via slide cylinder mounts 46. Slide hydraulic cylinder extensions 52*a*, 53*a* are each coupled via pulleys 52*b*, 53*b* to slide cables which are routed through sheaves and anchored at a first end to the frame 40 and at a second end to track 20. As described in further detail the slide cables are arranged to enable movement of the trolley 30 horizontally a given distance, such as but not limited to a minimum of one full trolley width.

On the opposite side of the frame 40 a lift rail 42 includes a lift hydraulic cylinder 78 coupled to a lift cylinder block 160 which is in turn coupled via a belt (not shown) routed to a lifting block 180, which in turn is coupled with a plurality of cables routed through various sheaves and coupled to lifting bars 260 arranged to enable vertical movement of the platform 300 upon actuation of the lift hydraulic cylinder 78. The lift rail 42 may include channels such as channels 72, 76 in which the lifting block 180 and lift cylinder block 160, respectively, are slidably retained. The slide rail 41 and lift rail 42 of the frame 40 are connected to each other at each end by support members 43 and 44. The trolley 30 may include tensioning cables 60 to reduce or eliminate frame torsion. A sliding roller 240 at each corner of the frame 40 is positioned to engage in tracks 20 which can run the width of a parking system. It be apparent to the skilled artisan that a greater or lesser number of sliding rollers may be employed and positioned in suitable positions to achieve horizontal movement of the trolley 30. Sheaves 120, 122, 112 (shown in phantom) and 124 are described in further detail with reference to FIGS. 21-26.

Space Conservation

Figure 5:
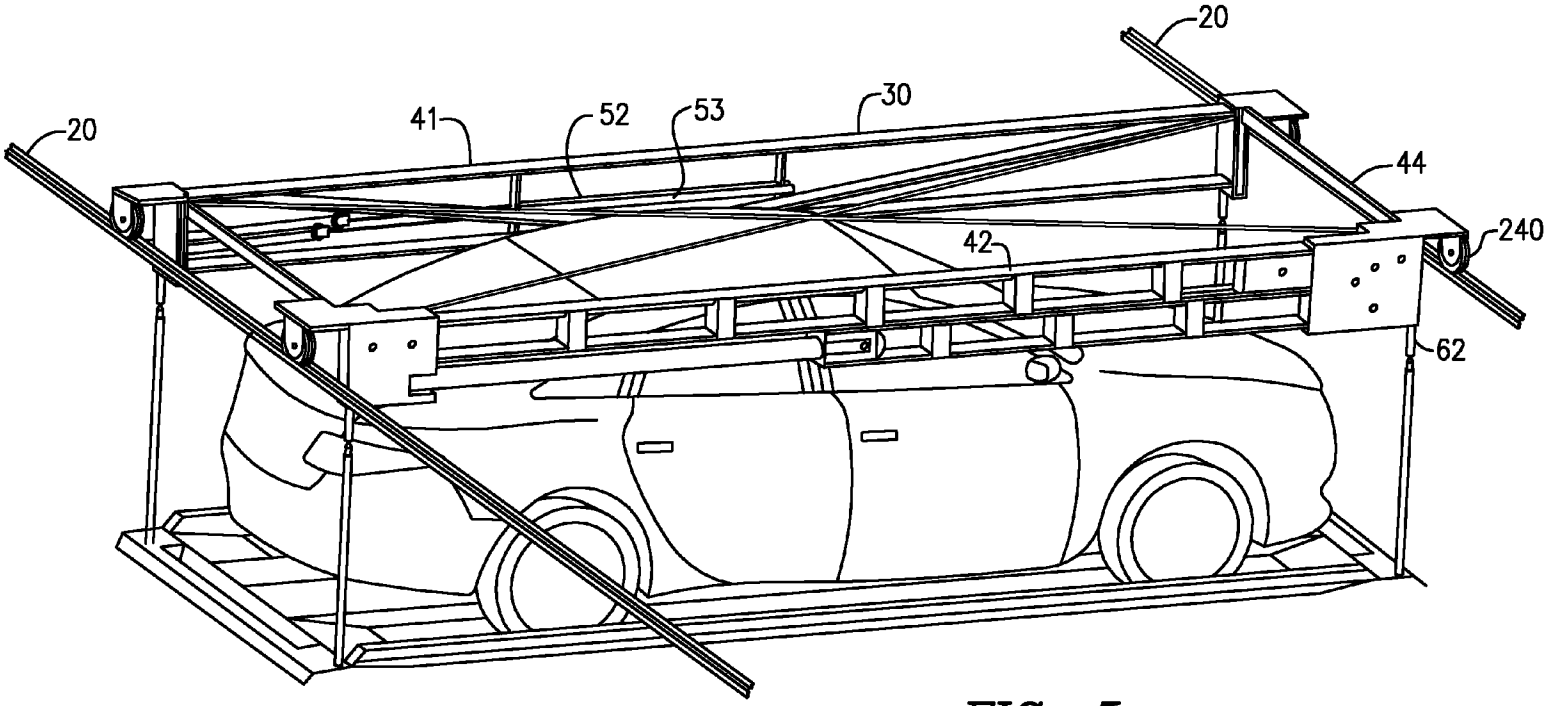
FIG. 5 is an elevated perspective view of a trolley with a car parked thereon in accordance with an embodiment of the present disclosure.
Figure 5A:
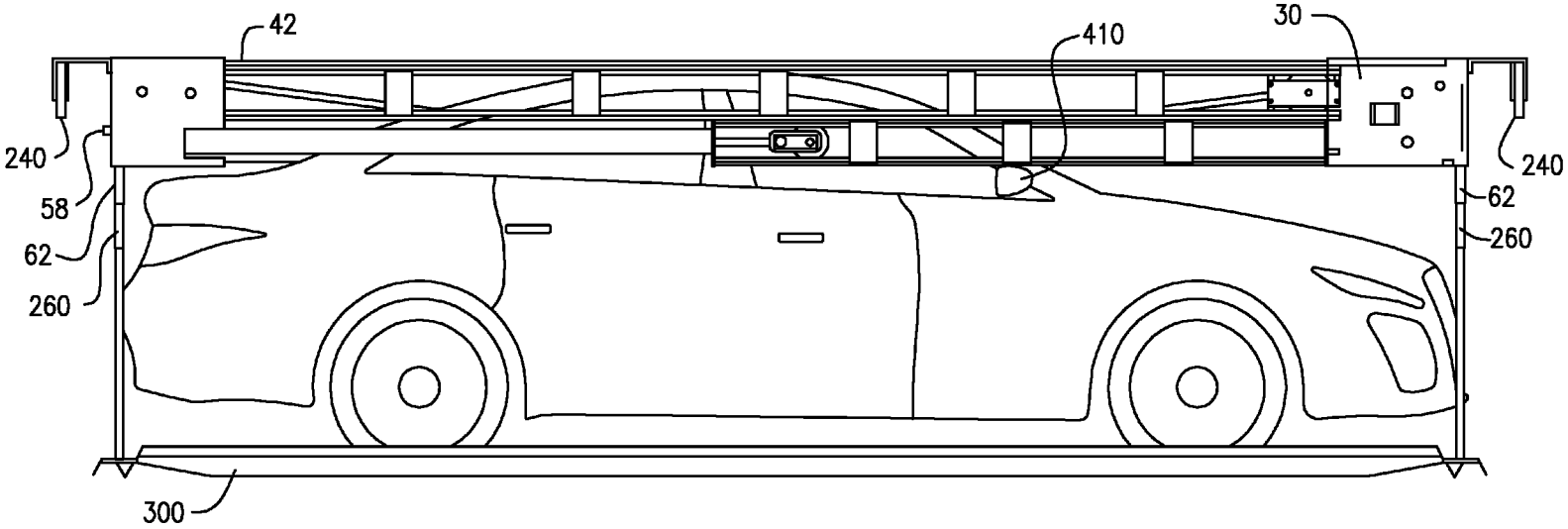
FIG. 5A is a side view of a trolley with a car parked thereon as shown in FIG. 5 in accordance with an embodiment of the present disclosure.
Figure 6:
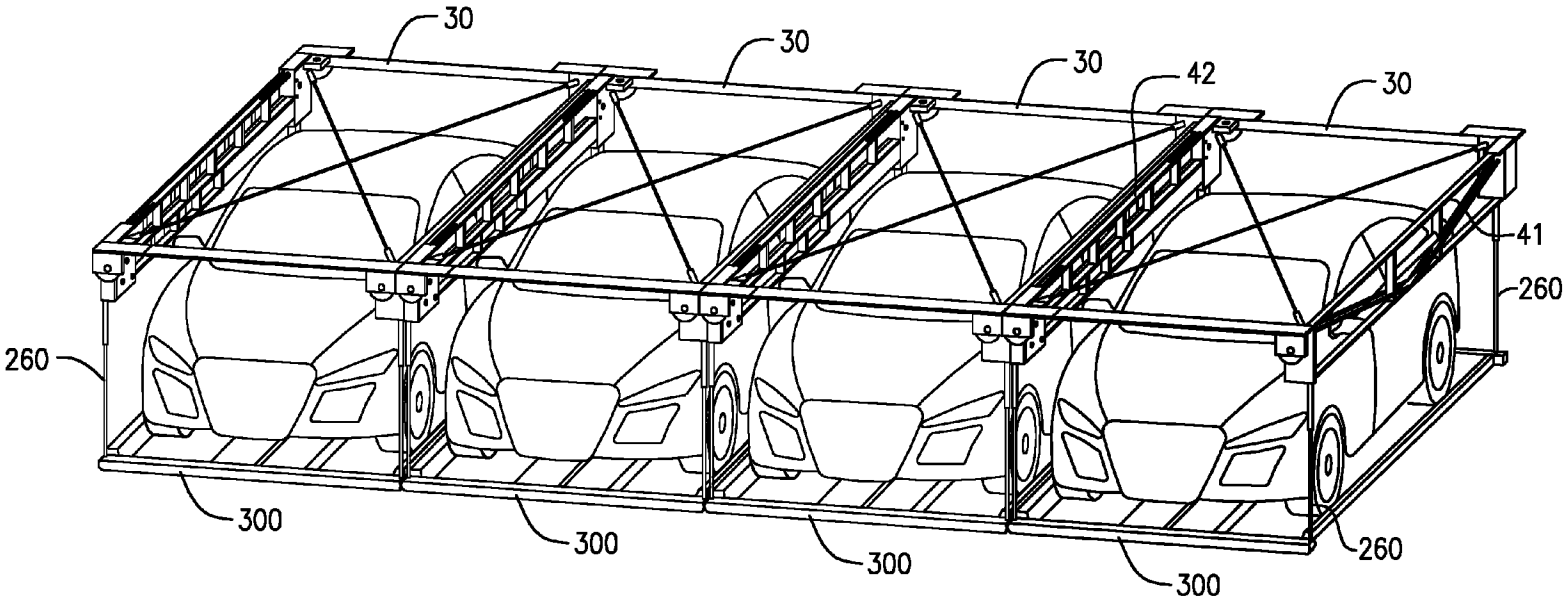
FIG. 6 is an elevated perspective view of a plurality of adjacent trolleys containing cars in accordance with an embodiment of the present disclosure.
Figure 7:
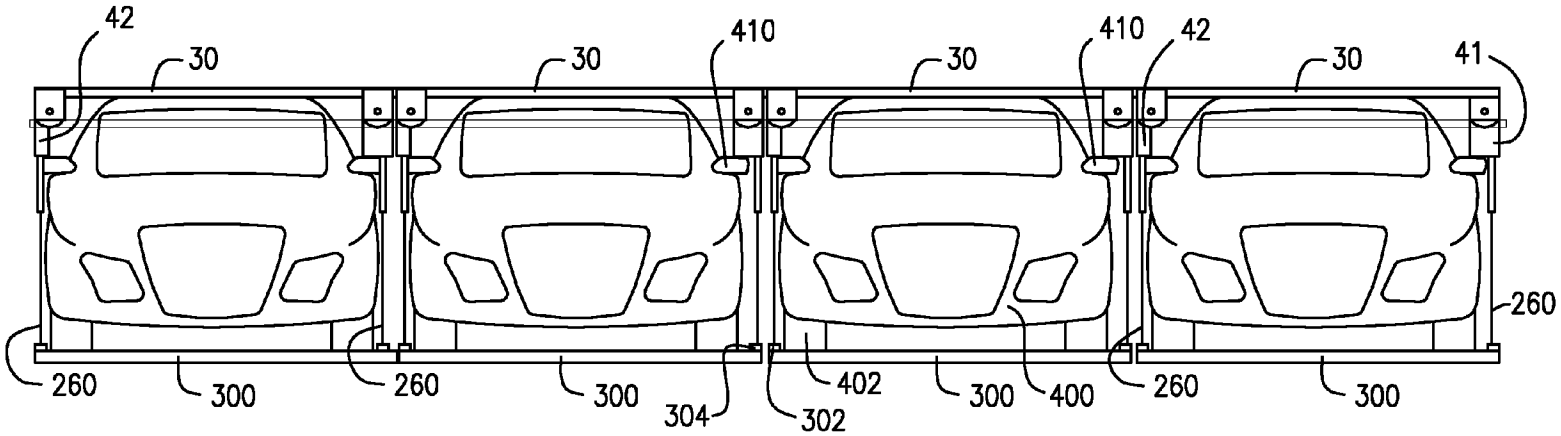
FIG. 7 is front view of a plurality of adjacent trolleys according to FIG. 7 in accordance with an embodiment of the present disclosure.

Now referring to FIGS. 5-7, one or more trolleys 30 that may be employed in connection with the presently disclosed subject matter are depicted with a vehicle positioned thereon to illustrate, among other things, some of the space-saving advantages. FIGS. 5-7 demonstrate that because the platforms 300 are not lifted inside the framework of the trolley 30, the bottom sides of the slide rail 41 and lift rail 42, can be positioned just above the rear view mirrors of the vehicle when the platform 300 is in the fully raised position, allowing much closer spacing of the stored vehicles while keeping their cumulative width to a minimum. This decreases the width of the trolley 30 and the overall width of the entire system. FIG. 5A shows the top of the lifting bars 260, are seated within stabilizing tubes 62 which prevents the platform 300 from swinging when the trolley 30 is moved. The rearview mirrors 410 of the car 400 are positioned below the lift rail 42.

FIGS. 6 and 7 also demonstrate how close the trolleys 30 can be positioned to each other within the parking system. The trolleys 30 are and configured in certain embodiments to accommodate the largest vehicle to be parked within each system. The width of platform 300 is designed so that the largest vehicle can be driven onto it using the curbs on either side to keep the vehicle centered on the platform 300. All the lifting bars 290 are spaced to allow the vehicle mirrors to pass. In the embodiment shown in FIG. 7 the cars 400 are offset the maximum amount with the tires 402 on the right-hand side of the car against the parking curb 302 of the platform 300. This shows the platform 300 automatically centers the car 400 using the curbs 302, 304 on either side of the platform 300. As shown, the slide rail 41 and lift rail 42 only occupy the space above the rear view mirrors 410, allowing the roof section of the vehicle to pass between them the rails 41, 42 while the rearview mirrors 410 are positioned below the rails 41, 42. Not requiring the widest vehicle width (measured including rearview mirrors) to pass completely between the two rails 41, 42 greatly decreases the width of the trolley 30 and the overall system 2 allowing the entire parking system 2 to have a much smaller footprint.

Trolley Sliding Apparatus

Figure 8:
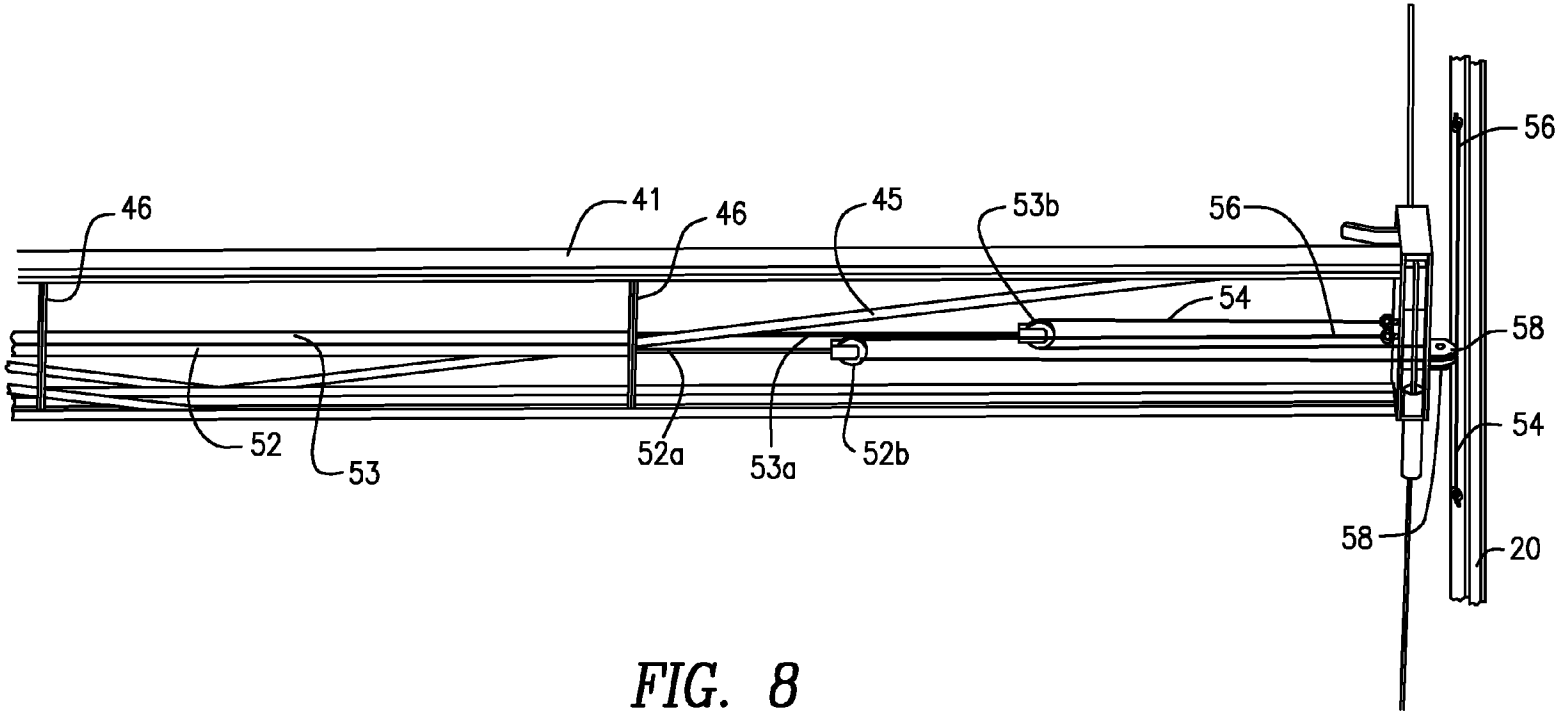
FIG. 8 is side view of a sliding rail and sliding cylinders in accordance with an embodiment of the present disclosure.
Figure 9:
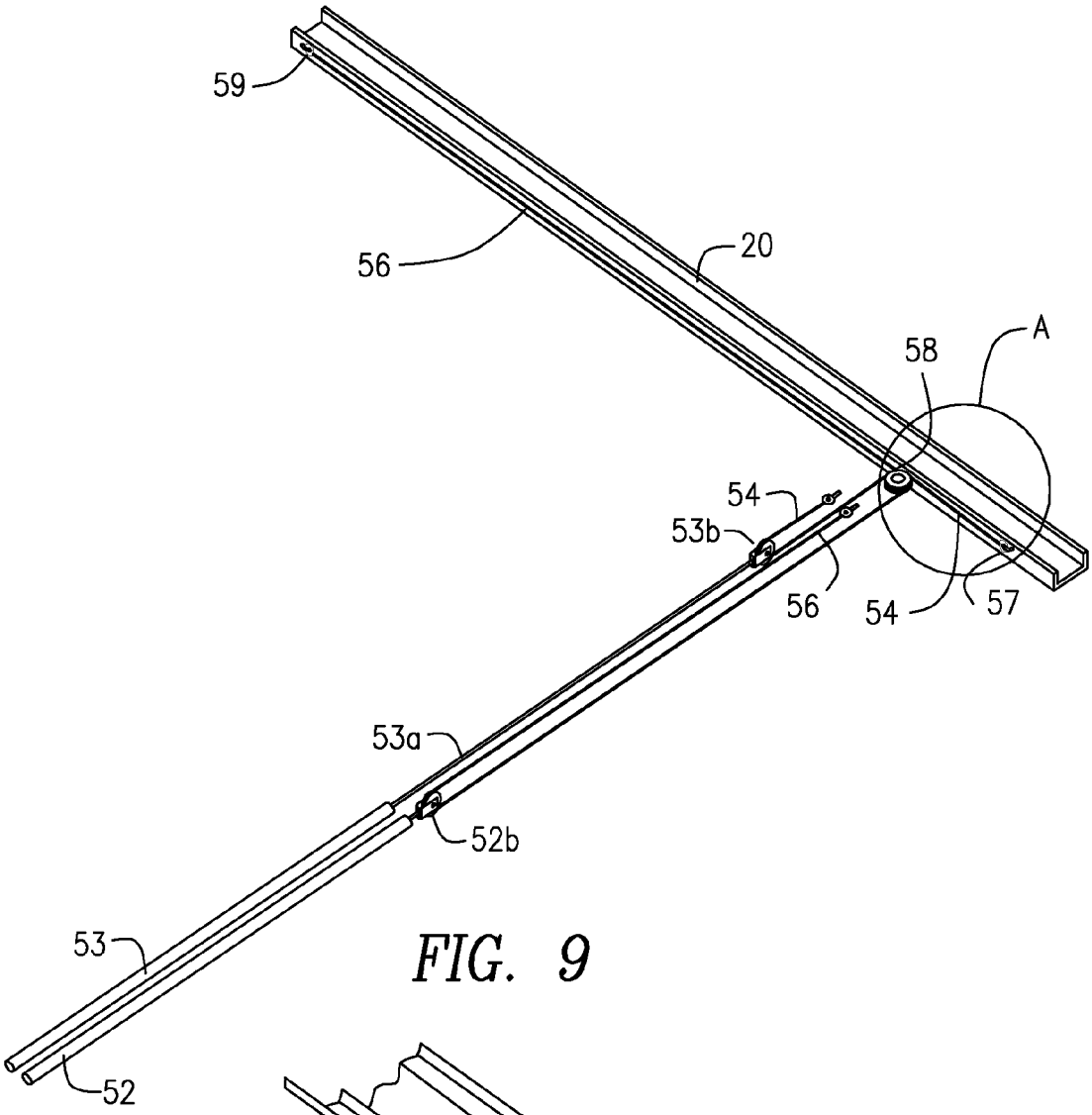
FIG. 9 is an elevated perspective view of a sliding rail and sliding cylinders in a first position in accordance with an embodiment of the present disclosure.
Figure 9A:
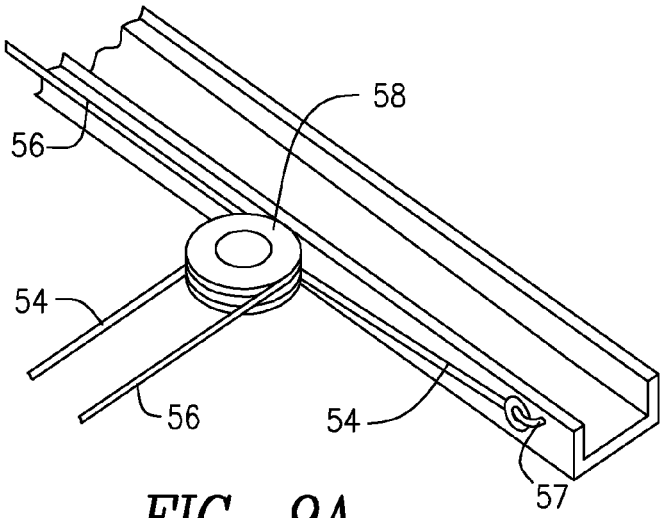
Figure 10:
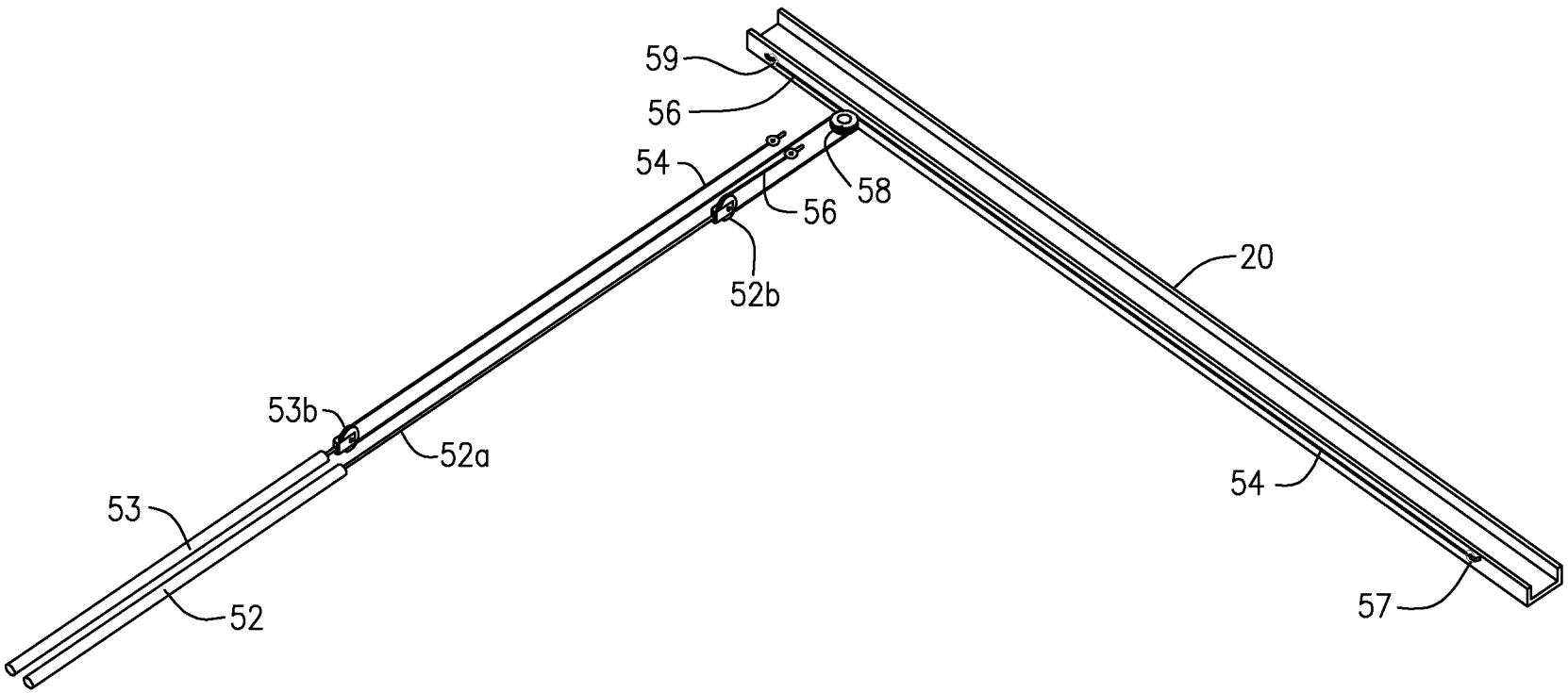
FIG. 10 is an elevated perspective view of a sliding rail and sliding cylinders in a second position in accordance with an embodiment of the present disclosure.

Now referring to FIG. 8, slide hydraulic cylinders 52, 53 are mounted on the slide rail 41 such as to mounts 46. The slide hydraulic cylinders 52, 53 are used to initiate horizontal movement, or sliding action, of the trolley 30. The slide hydraulic cylinders 52, 53 have extensions 52*a*, 53*a*, respectively, which are coupled to pulleys 52*b*, 53*b*, respectively, around which are routed slide cables 56 and 54, respectively, which are in turn anchored at respective first ends to the trolley 30 and at respective second ends to the track 20. Due to the novel configuration of the cables 54 and 56 and pulley configuration, described further herein below, actuation of one of slide hydraulic cylinders 52 or 53 serves to the pull the trolley 30 in one horizontal direction, while actuation of the other slide hydraulic cylinders 52 or 53 serves to pull the trolley 30 in the opposite direction. With further reference to FIGS. 9, 9A and 10, one slide cable 54 is anchored in the slide rail 41 and is routed over pulley 53*b* of slide hydraulic cylinder 53, then proceeds to a slide direction changing sheave 58 mounted at the end of the slide rail 41 where it then passes to an anchor 57 on the track 20 a sufficient distance from the trolley 30 to allow it to slide a predetermined distance. The other sliding cable 56 is attached similarly at an anchor point in the slide rail, passes through pulley 52*b* of slide hydraulic cylinder 52, then proceeds to slide direction changing sheave 58 and is routed in a direction opposite to that of cable 54 to an anchor 59 on the track a sufficient distance from the trolley 30 to allow the trolley 30 to slide a predetermined distance. As will be apparent to the skilled artisan, the predetermined distance will be dictated by several factors, such as but not limited to the particular size of the trolley, the superstructure itself, etc. As will also be apparent, one or both of the anchors 57, 59 may be located on a bottom of the track 20. These anchors may be located at any point on the track 20 that will not obstruct movement of the trolley 30. FIG. 10 shows that actuation of one of the slide hydraulic cylinders will serve to the pull the trolley (not shown) in the direction opposite the configuration shown in FIG. 9.

Lifting Bars

Figure 11:
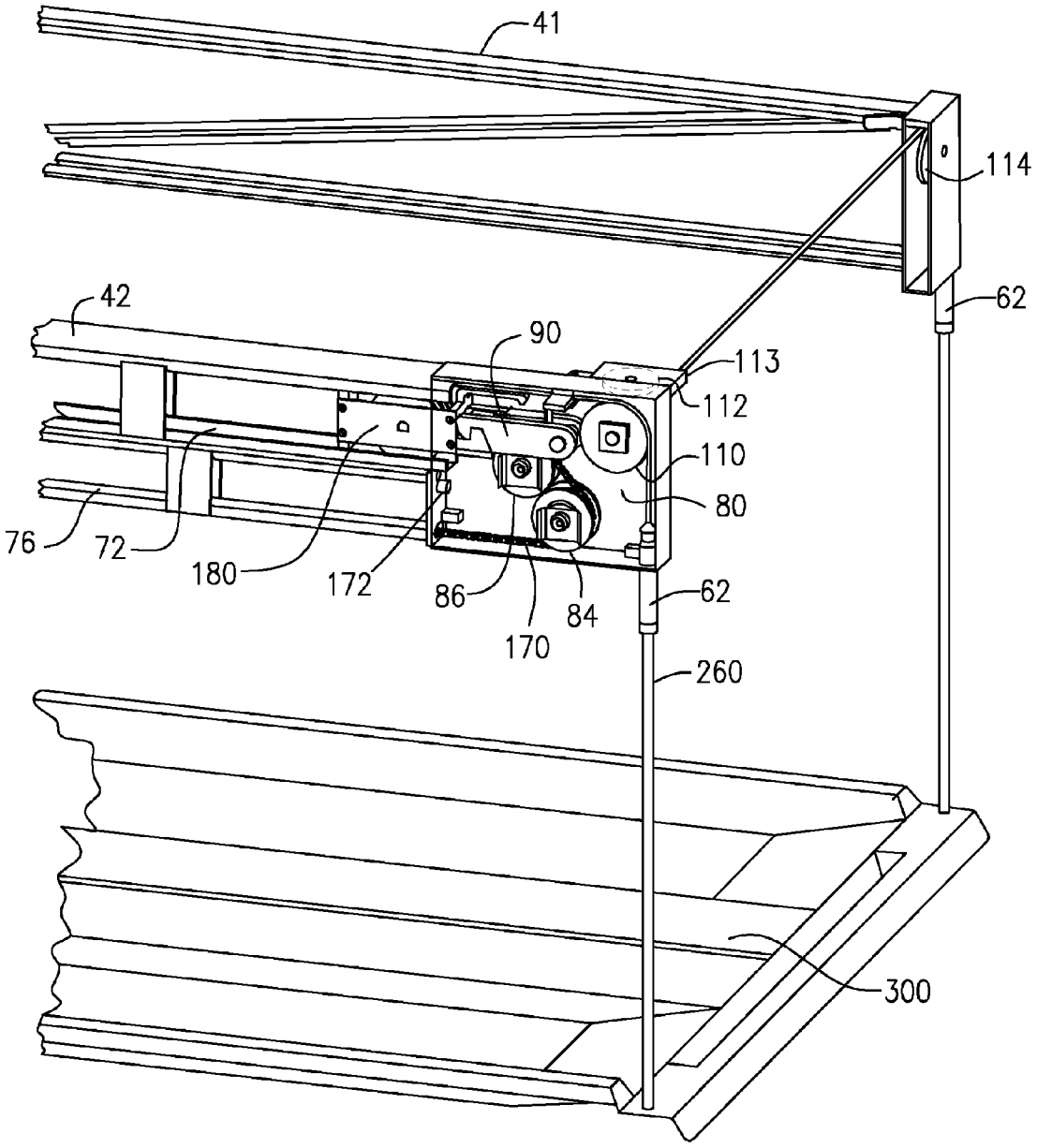
FIG. 11 is an elevated perspective view of a section of a trolley with a lifting rail, a latch assembly, sheaves and lifting block, with lifting cables extending to lifting bars positioned in stabilizing tubes positioned at opposite corners of a platform in a raised position in accordance with an embodiment of the present disclosure.
Figure 11A:
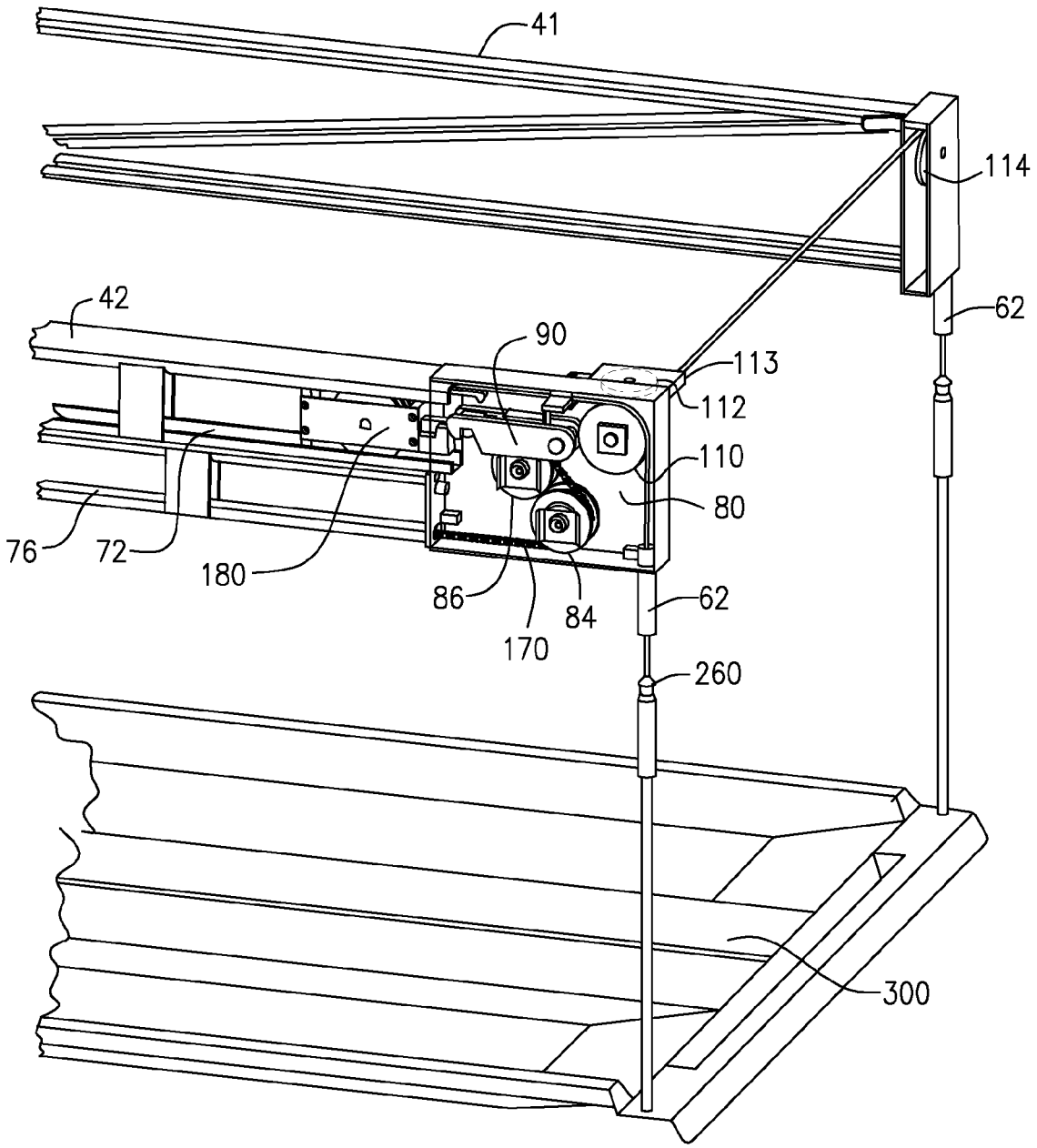
FIG. 11A is an elevated perspective view of a section of a trolley with a lifting rail, latch assembly, sheaves and lifting block, with lifting bars positioned outside the stabilizing tubes and extending to a platform in a slightly lowered position in accordance with an embodiment of the present disclosure.

Now referring to FIGS. 11-11A, the platform 300 depending from each trolley 300 includes lifting bars 260 positioned at each of the four corners of the platform 300 coupled to lift cables. Stabilizing tubes 62 depending from four corners of the frame are sized and configured to receive lifting bar ends 262 when the platform 300 is in the fully raised position. The lifting bars 260 when positioned in the stabilizing tubes 62 reduce or eliminate sway of the platform 300 and add overall stability to the trolley. As the lifting block 180 disengages from the safety latch 90 and the platform 300 is lowered (FIG. 11A), the lifting bars 260 are lowered from the stabilizing tubes 62.

FIGS. 11-11A also show lift horizontal direction sheave 112 mounted via plate 113 proximate mounting plate 80 and generally perpendicular thereto, and lift vertical directional sheave 114 mounted in a corner opposite that of the mounting plate 80.

Platform Lifting Apparatus

Figure 12:
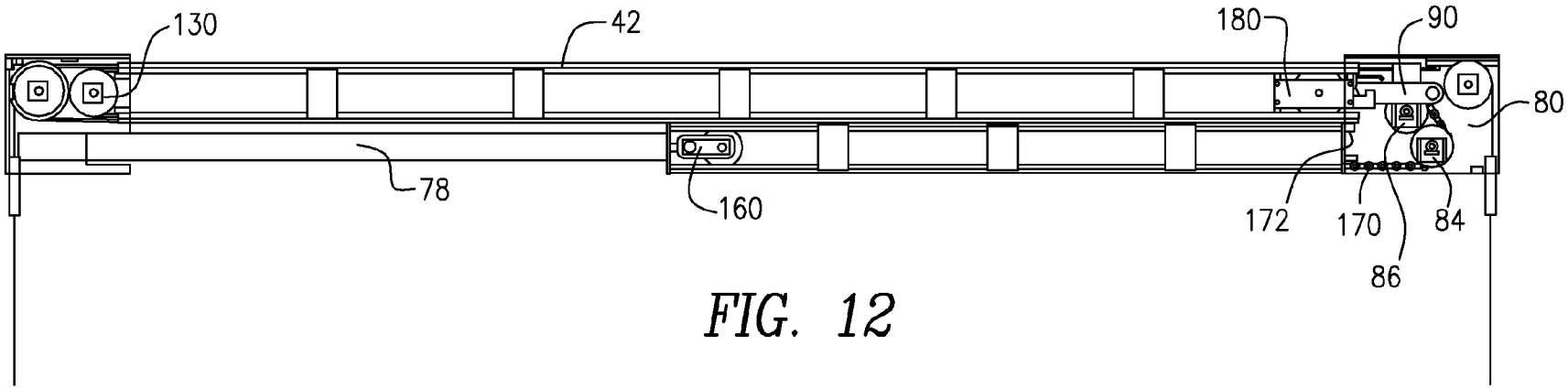
FIG. 12 is a side view of a lift rail of a trolley showing the lift hydraulic cylinder positioned with respect to the lifting rail and a lifting block engaged to the safety latch in accordance with an embodiment of the present disclosure.

Now referring to FIG. 12, a lift rail 42 is shown to demonstrate the means used to provide the maximum amount of lift while keeping the dimensions of the lift rail 42 to a minimum, and in particular, limited in overall height. The special reeving configuration and sheave arrangement of the platform lifting apparatus keep the height and width of the rail to a minimum so it will fit just above the rearview mirrors of the parked vehicle and require only a minimum amount of space in the parking structure.

The lift hydraulic cylinder 170 is positioned in the lower part of the rail 42 and includes a lift cylinder block 160 connected via a chain or belt 170 anchored to the trolley 30 via anchor 172 over rollers 84, 86, to the lifting block 180. The lifting block 180 is in turn coupled to a plurality of lifting cables (not shown) which are routed through a multiplier sheave 130 and one or more directional sheaves (not shown) to the lifting bars (not shown) at corners of the platform (not shown). This arrangement allows the lifting block 180 to travel a much further distance than would be possible if it were coupled directly to a lift hydraulic cylinder as it is in other types of mechanical parking systems. In one or more embodiments the lift hydraulic cylinder 170 is coupled to the lifting block 180 at a 2:1 ratio and the lifting block 180 is connected to the lifting cables using a 3:1 ratio. By way of illustration, in a conventionally designed hydraulic lift-slide-type system, wherein the cylinder is coupled directly to the lifting cables at the typical 3:1 ratio, it will achieve a total lift of approximately 3×35% of the lifting rail length because the cylinder with its block and the various multiplier sheaves and directional sheaves must occupy a portion of that length. Given a rail with a length of 10 units a conventional system will be able to lift approximately 3×(35%×10)=10.5 units. In contrast, embodiments of the presently disclosed subject matter are able to lift approximately 3×(85%×10)=25.5 units, almost 2.5 times that of a conventionally designed system.

Figure 13:
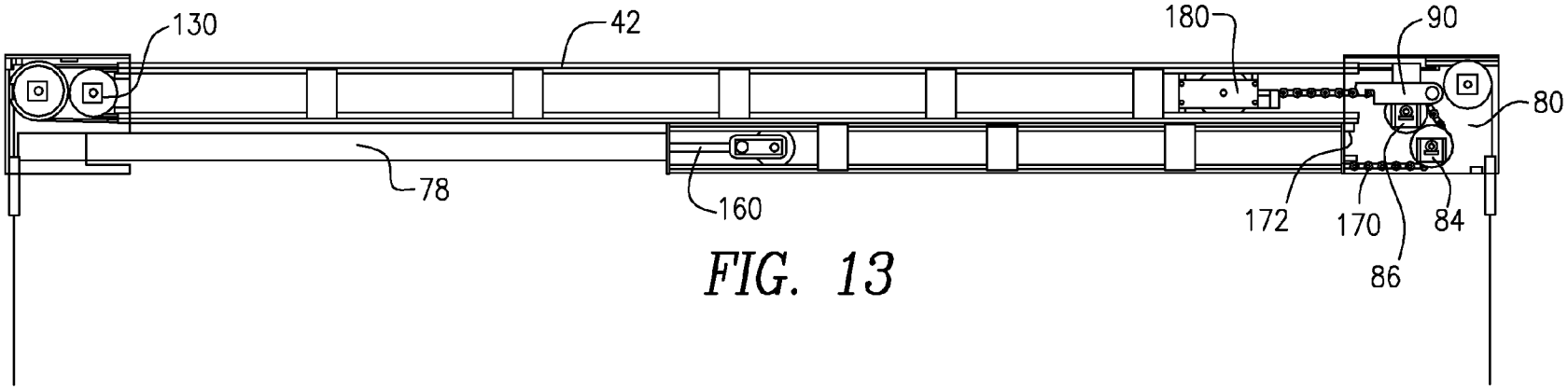
FIG. 13 is a side view of a lift rail of a trolley showing the lift hydraulic cylinder positioned with respect to the lifting rail and a lifting block released from the safety latch in accordance with an embodiment of the present disclosure.
Figure 14:
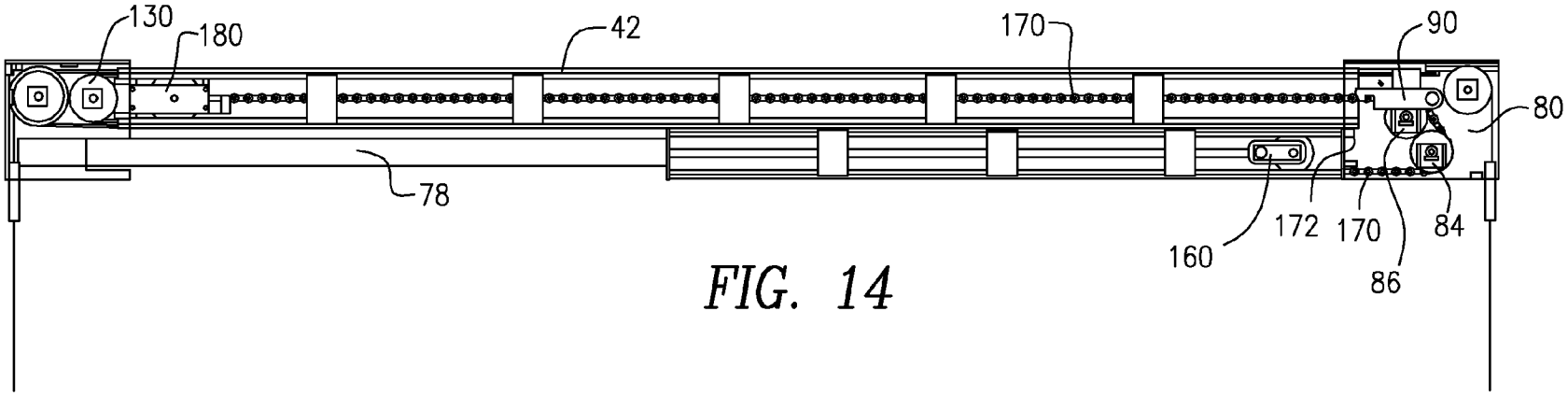
FIG. 14 is a side view of a lift rail of a trolley showing the lift hydraulic cylinder positioned with respect to the lifting rail and a lifting block released from the safety latch in accordance with an embodiment of the present disclosure.

Now referring to FIG. 13, a side view of the lifting assembly demonstrates the relationship between the movement of the lift cylinder block 160 and that of the lifting block 180. The lift cylinder block 160 has slightly extended from the lift hydraulic cylinder 78 and the lifting block 180 has moved away from its fully locked position as shown in FIG. 11. With further reference to FIG. 14 the fully extended position of the lift hydraulic cylinder 78 and the lift cylinder block 160 is shown and its relationship to the lifting block 180. This shows the much greater movement allowed the lifting block 180 which results in increased lifting height without the need to increase the reeving ratio of the cables and subsequently the diameter of the lift hydraulic cylinder 78.

FIGS. 12-14 show the safety latch 90 hingedly mounted to mounting plate 80 and positioned proximate the rollers 84, 86.

Safety Latch

Figure 15:
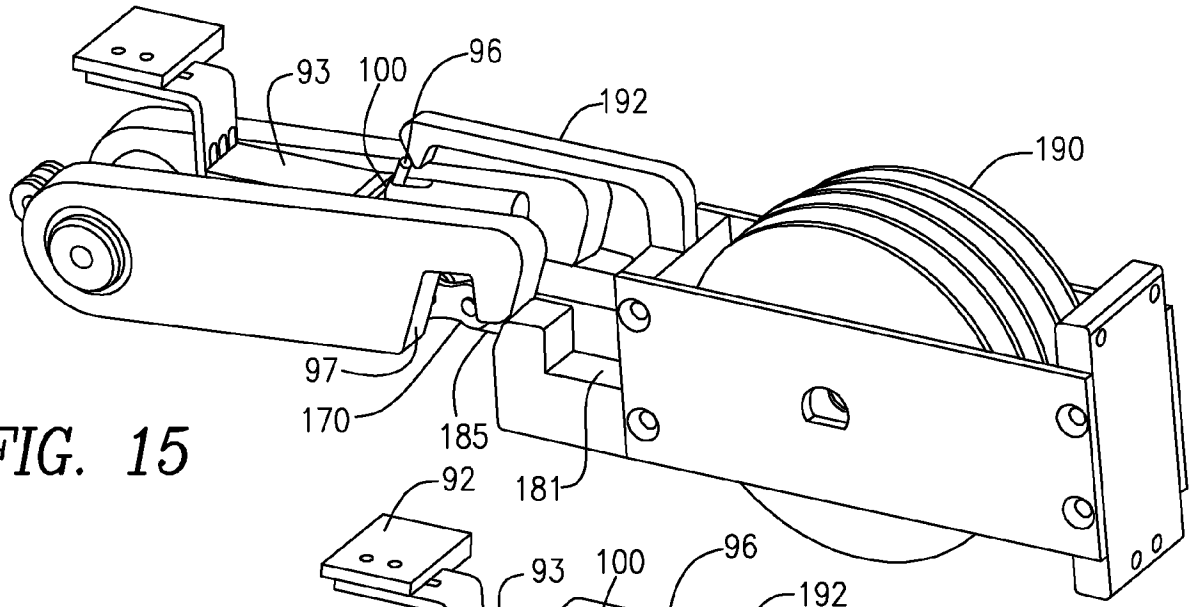
FIGS. 15-20 are perspective views of a safety latch and lifting block in various stages of engagement/disengagement, in accordance with an embodiment of the present disclosure.
Figure 16:
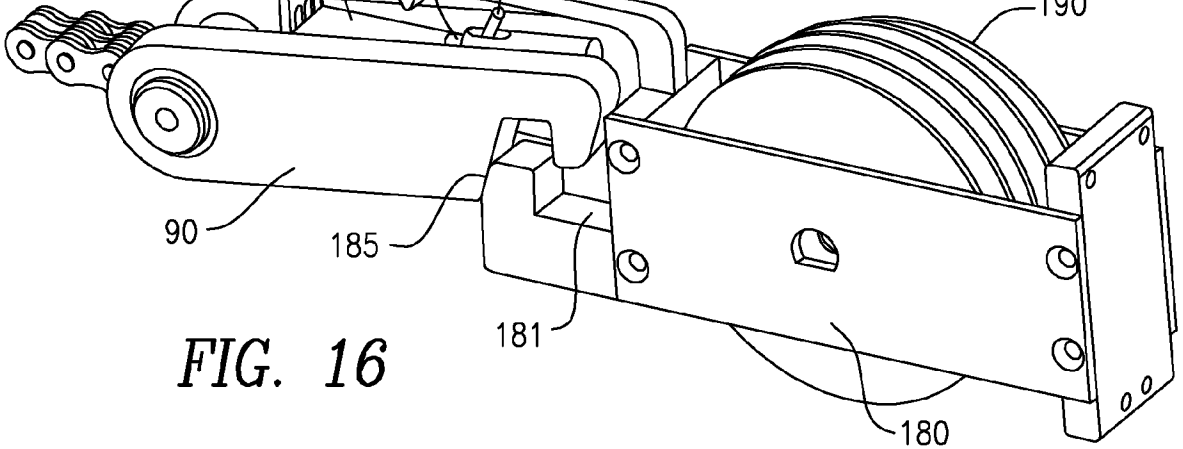
Figure 17:
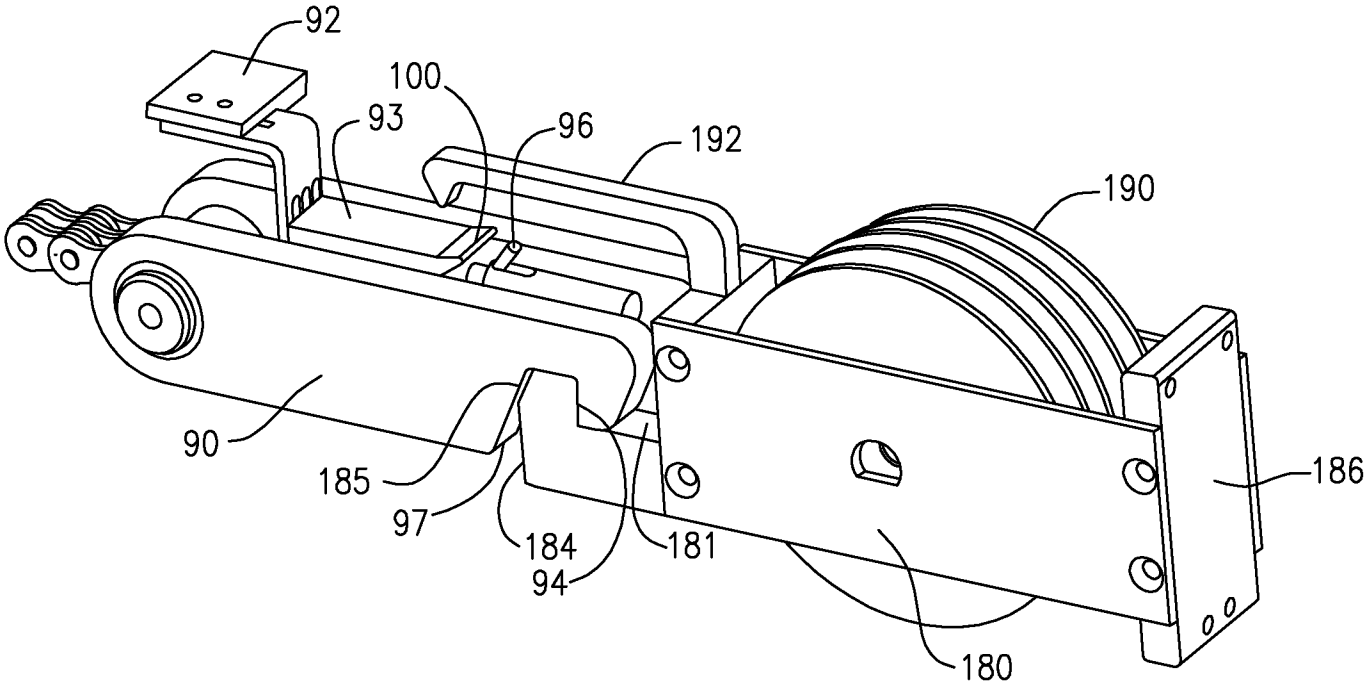

With further reference to FIGS. 15-20, the lifting block 180 is operable to engage a pawl 94 of safety latch 90. With reference to FIG. 15, the lifting block 180 includes a front end 184 configured to contact a leading edge of the safety latch pawl 94 and urge the pawl 94 in an upward direction as the lifting block 180 moves toward the safety latch 90. The front end 184 may have a ramp 185 to facilitate upward movement of the safety latch pawl 94 upon continued movement of the lifting block 180 in the direction of the safety latch 90. As the safety latch 90 moves upward a spring-loaded engagement pin 100 which is connected to the safety latch pawl 94 is depressed by a latch holding bar 93 adjustably mounted to the lift rail via bracket 92. A release finger 192 extends from the lifting block 180 which is traveling just above a release tab 96 on the spring-loaded engagement pin 100. When the front end 184 of lifting block 180 contacts the latch pawl 94 the latch pawl 94 cannot be raised high enough for the spring-loaded engagement pin 100 to pass the latch holding bar 93 or the release finger 192 to touch the release tab 96. With further reference to FIG. 16, the safety latch 90 is shown in the fully raised position just as the lifting block 180 is finishing its movement. In this position the spring-loaded engagement pin 100 is being depressed by the latch holding bar 93 and the release finger 192 is well past the release tab 96 on the safety latch pawl 94. With further reference to FIG. 17, the safety latch 90 is in the fully latched position engaged to recess 181 of the lifting block 180 after the lifting block 180 has finished its initial movement. The spring-loaded engagement pin 100 is fully extended. An electrical switch or some other means (not shown) may be used to indicate this position and to stop the lifting block movement.

Figure 18:
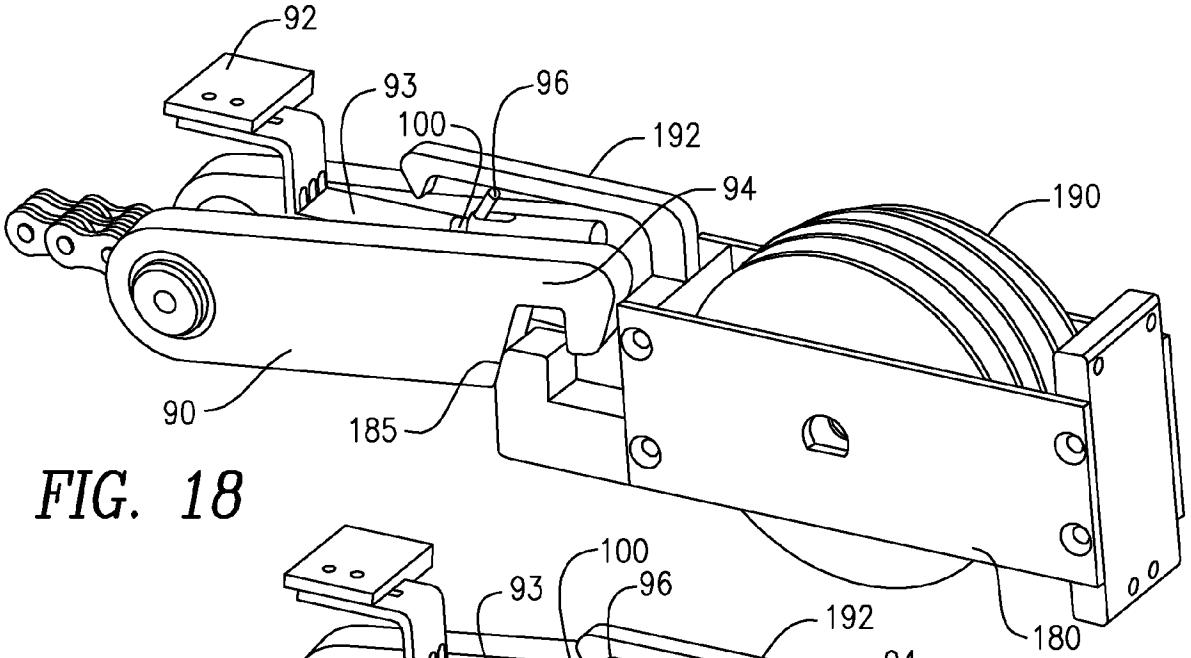
Figure 19:
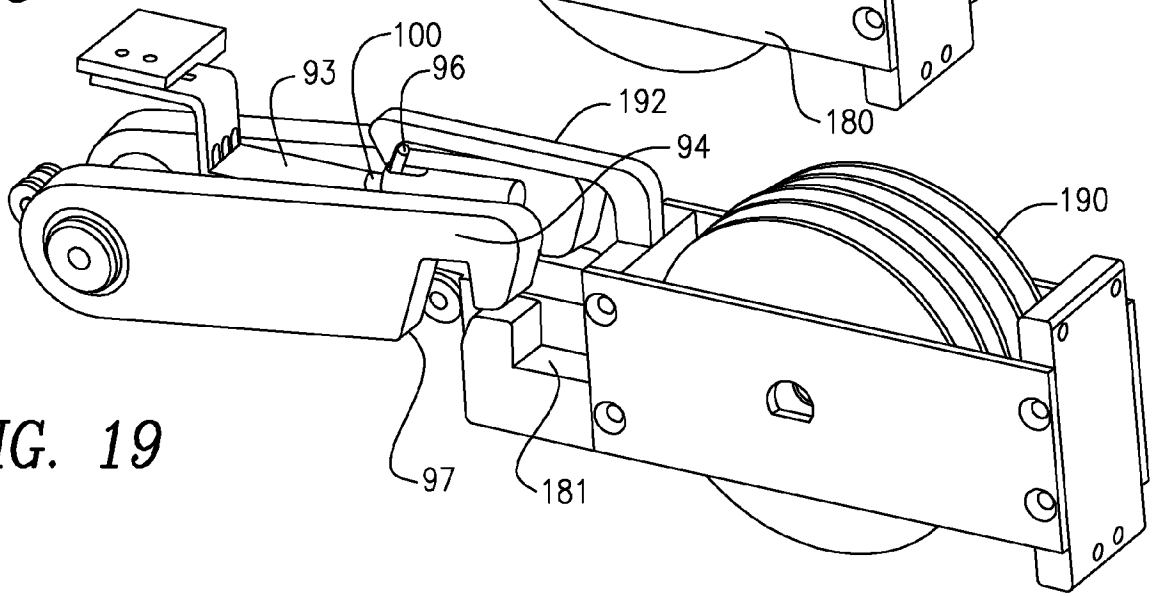
Figure 20:
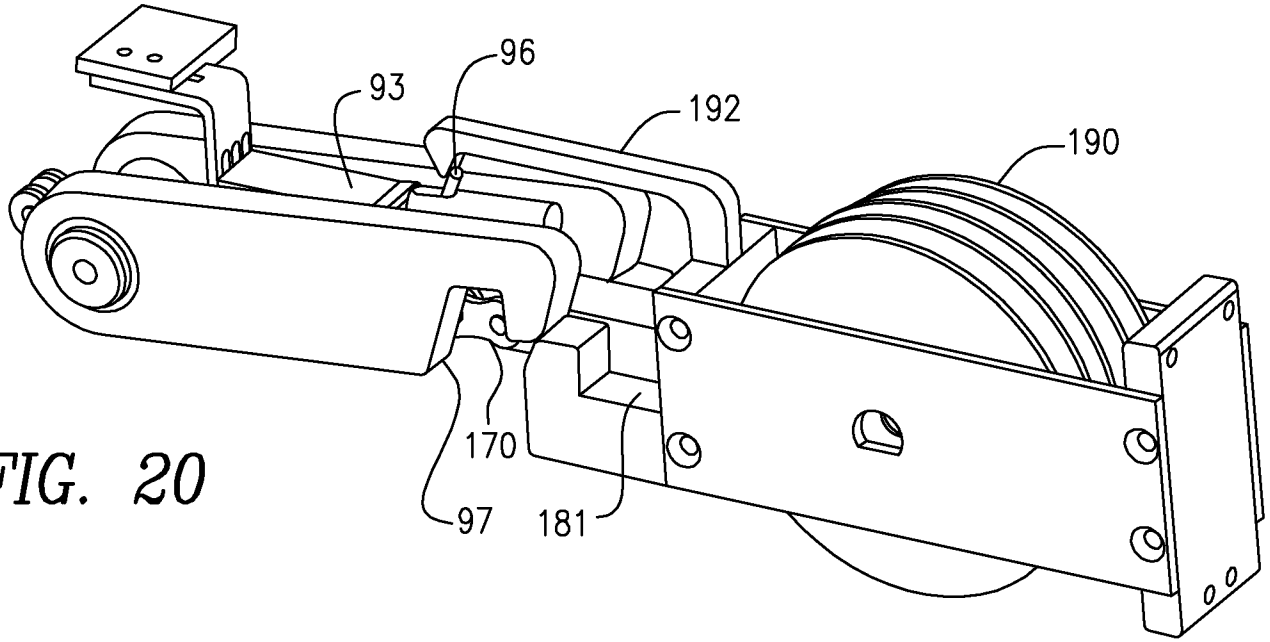

Now referring to FIG. 18, the safety latch 90 may be released by further movement of the lifting block 180 toward the safety latch 90. By this movement the front end 184 of the lifting block 180 urges the safety latch pawl rear face 97 upward. In one embodiment the safety latch pawl rear face 97 has a slanted face to facilitate the upward movement of the safety latch pawl 94. When the safety latch 90 reaches its fully raised position, the spring-loaded engagement pin 100 passes the latch holding bar 93 and holds the latch pawl 94 in the raised position. An electrical switch or some other means (not shown) maybe used to indicate this position and to reverse the movement of the lifting block 180. Now with further reference to FIG. 19, as the lifting block 180 moves away from the raised safety latch 90, and is in such a position where the safety latch pawl 94 will not engage the lifting block recess 181, the release finger 192 engages the release tab 96 on the spring-loaded engagement pin 100. With further reference to FIG. 20, further movement of the lifting block 180 causes the release finger 192 to push the release tab 93 inward and release the safety latch 90 from the raised position, returning the safety latch 90 to its lowered position.

Cable Arrangements

Now referring to FIGS. 21-26, the arrangement of cables and sheaves of the lifting assembly and sliding assembly is shown and described in detail. The arrangement is responsible for the raising and lowering of the platform and sliding of the trolley and is configured so that the lifting rail and the sliding rail can be made small enough to fit in the space above the rearview mirrors of the stored vehicles, thus eliminating much of the wasted space in conventional parking systems. The cylinder arrangement and sheave placement is critical for maintaining the narrowness and height of the rails.

Figure 21:
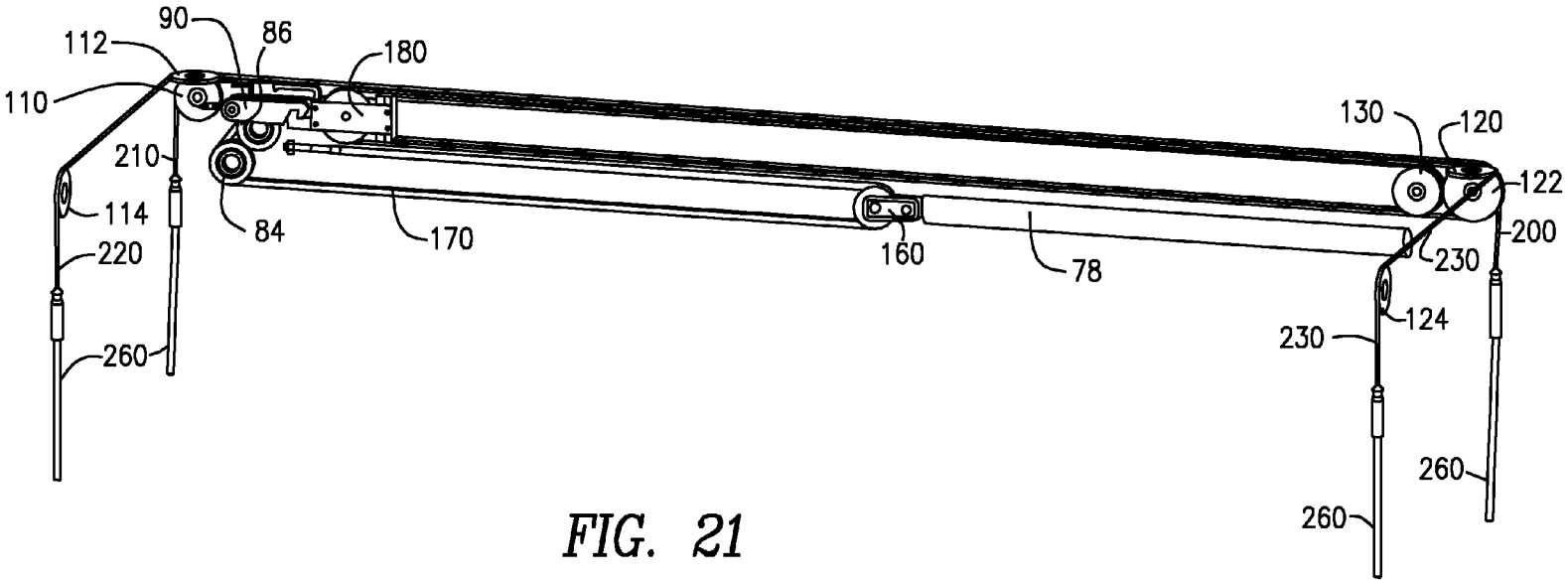
FIG. 21 is an elevated perspective view of a lifting assembly without the frame in accordance with an embodiment of the present disclosure.

Now referring to FIG. 21, the platform lift apparatus components are shown with structural parts of the frame removed for clarity. It will be apparent that the sheaves are mounted to various parts of the trolley in the orientation shown, and that the cables are routed through or along the trolley in the arrangement shown. Apertures or openings in the trolley accommodate passage of the various cables. The lift cylinder 78 is shown in a retracted position, the lift block 180 is shown engaged to safety latch 90 and lift bars 260 are fully raised. Belt 170 is anchored at one end to the trolley (not shown) and is fed around lift cylinder block 160 extending from one end of the lift cylinder 78 and around rollers 84, 86 and coupled to the lift block 180. The lift cylinder 78 is anchored at one end to the lift rail (not shown). Lift cables 200, 210, 220 and 230 extend from end 186 of the lift block 180. Each of lift cables 200, 210, 220 and 230 are fed through various sheaves to a lift bar 260 depending from the corners of the frame (not shown). Exemplary routing for each of the lift cables 200, 210, 220 and 230 is further described as follows.

Figure 22:
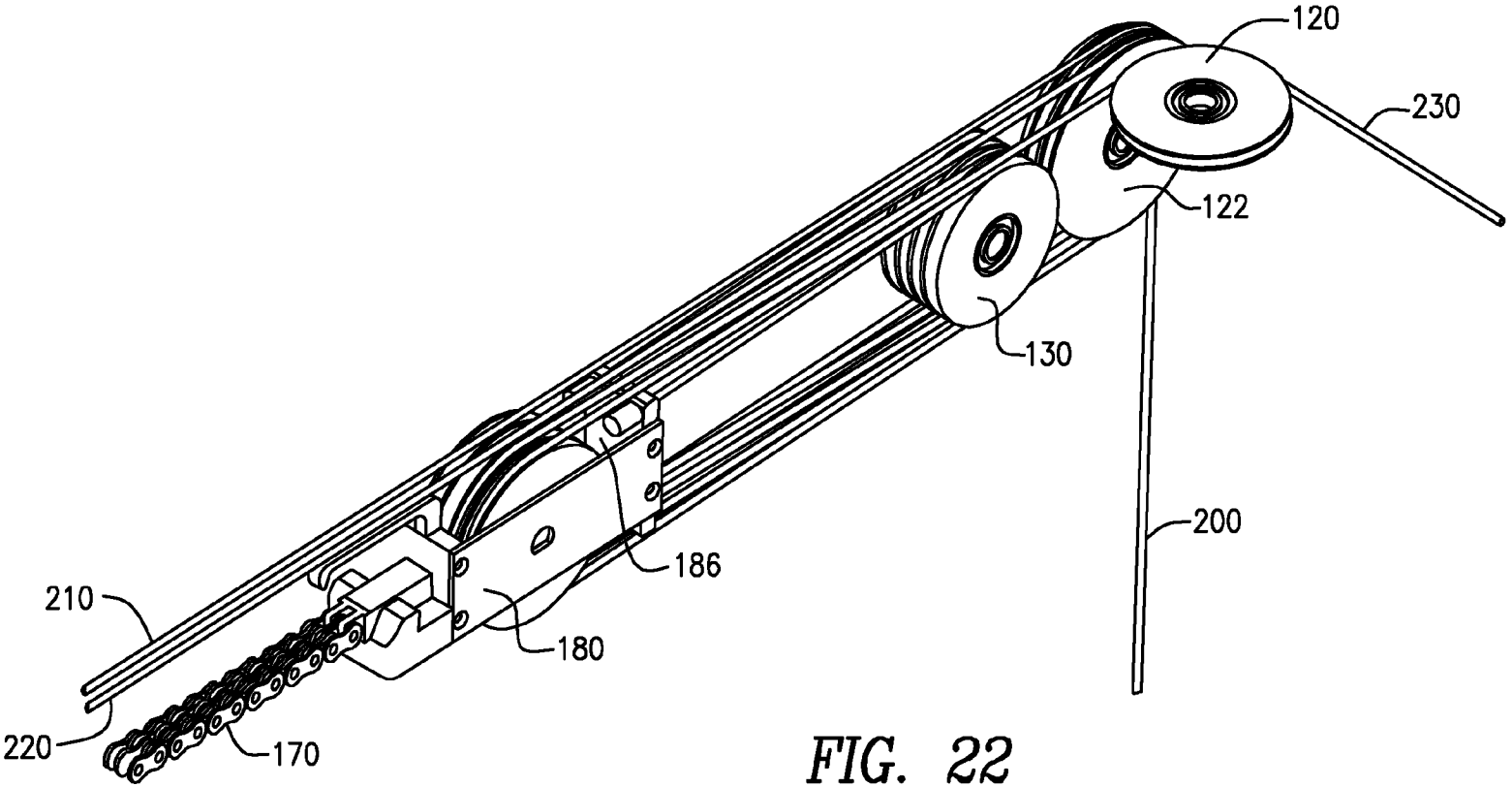
FIG. 22 is an elevated perspective view of a lifting block and a plurality of lift cables arranged on sheaves in accordance with an embodiment of the present disclosure.
Figure 23:
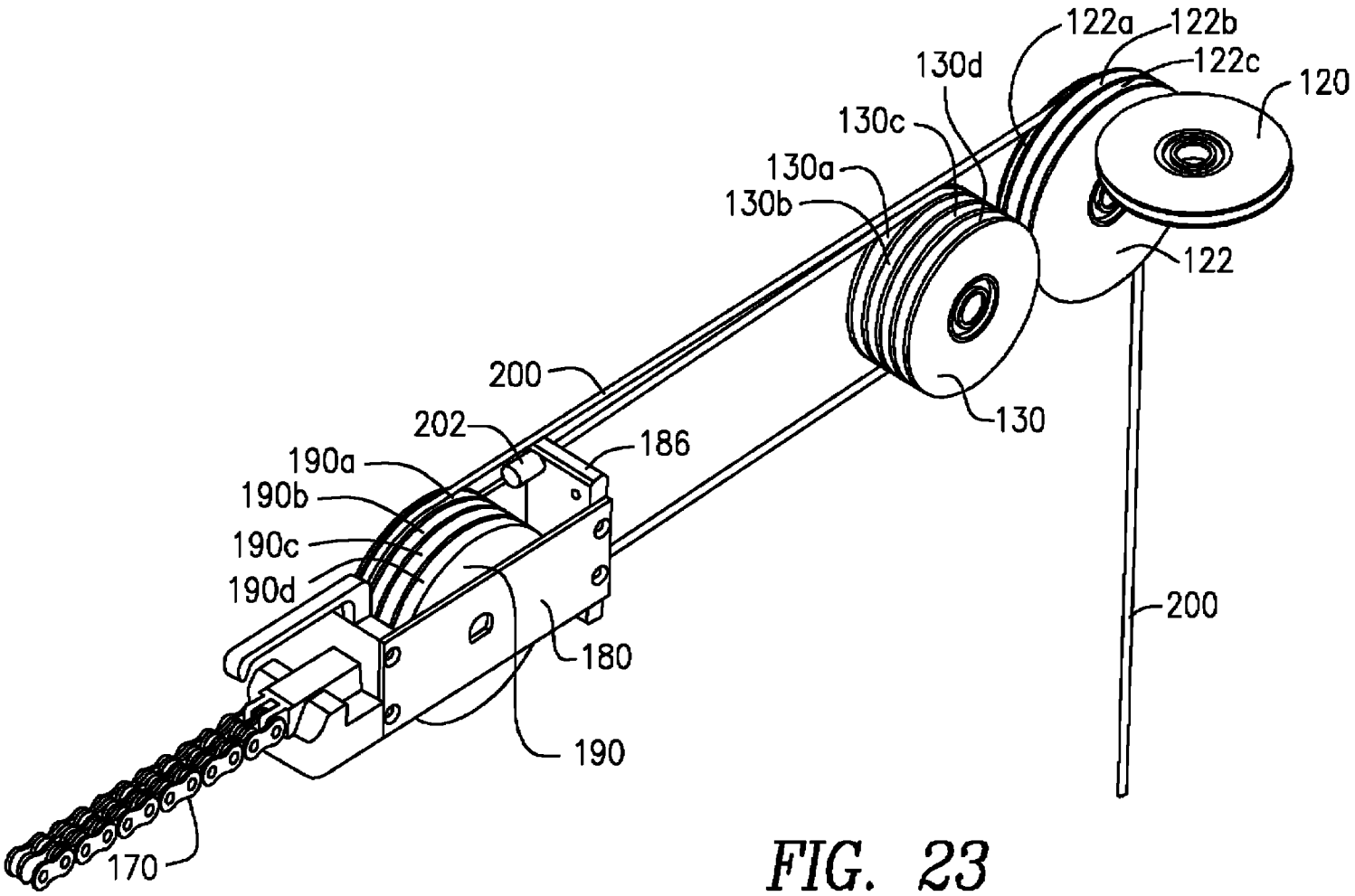
FIG. 23 is an elevated perspective view of a lifting block and a first lift cable arranged on sheaves in accordance with an embodiment of the present disclosure.

Now referring to FIG. 22, a detailed view is shown of the lift block 180, the ratio multiplication sheave 130, a lift vertical directional sheave 122 and a horizontal directional sheave 120 and lift cables 200, 210, 220 and 230. With reference to FIG. 23, lift cable 200 is fixed to a top portion of the rear end 186 of the lift block 180. The lift cable 200 may for example be fixed by routing through a hole in the rear end 186 of the lift block 180 and held in place by a button 202 swaged on the end of the cable 200. The lift cable 200 is then routed around groove 130*a* of the ratio multiplication sheave 130, back and around the groove 190*a* of lift block sheave 190 and then around groove 122*a* of a lift vertical directional sheave 122 positioned proximate and in axial alignment with the ratio multiplication sheave 130, and routed downward to terminate at a lift bar 260 as shown in FIG. 21. In the illustrative example all of the grooves 190*a*, 130*a* and 122*a* for lift cable 200 are in straight line alignment.

Figure 24:
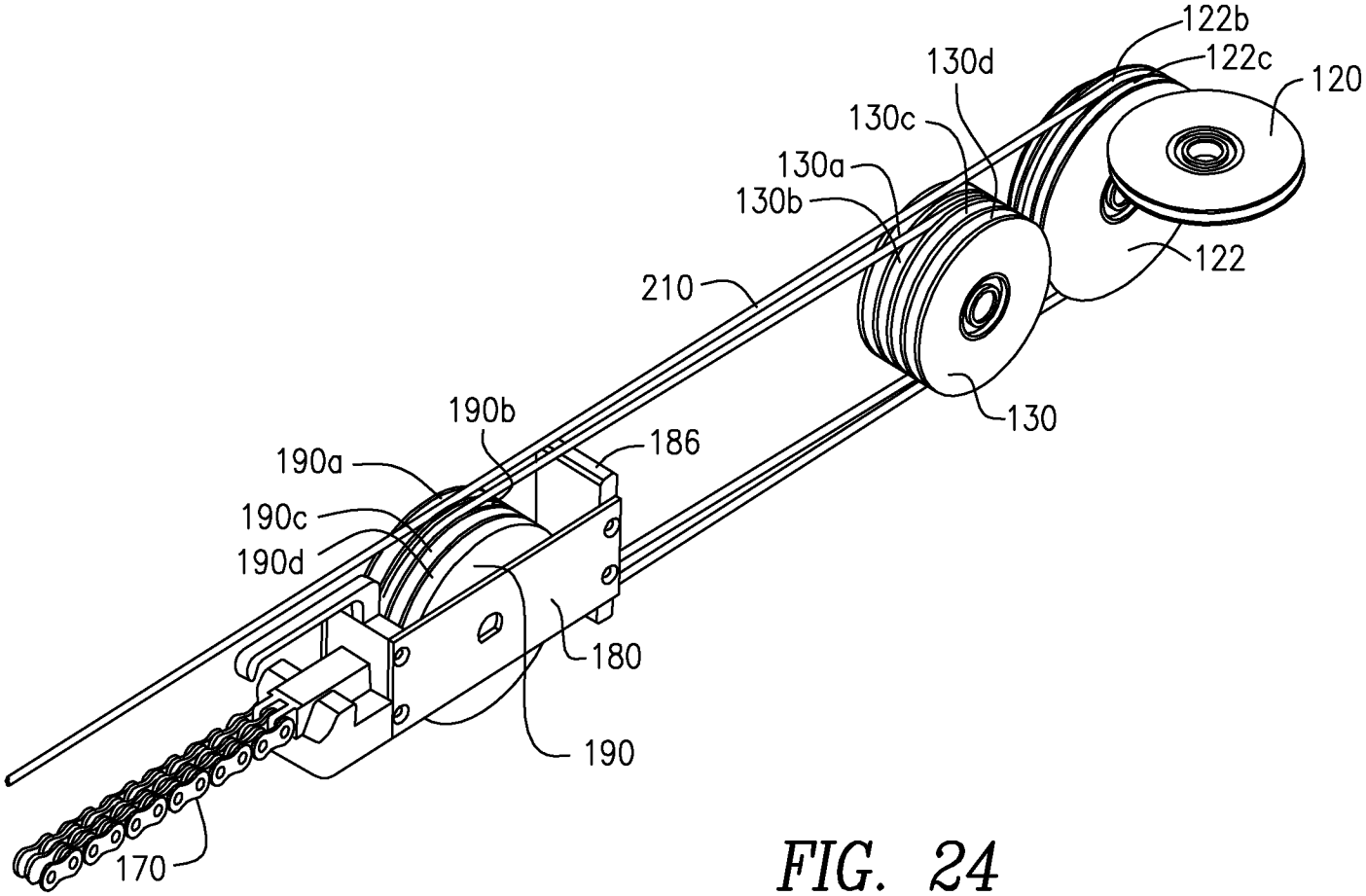
FIG. 24 is an elevated perspective view of a lifting block and a second lift cable arranged on sheaves in accordance with an embodiment of the present disclosure.

Now referring to FIG. 24, lift cable 210 is fixed to a bottom portion of rear end 186 of the lift block 180 such as by routing through a hole in the bottom of the rear end 186 of the lift block 180 and held in place by a button (not shown) swaged on the end of the cable 210. Lift cable 210 is then routed around groove 130*b* of the ratio multiplication sheave 130, back and around groove 190*b* of the lift block sheave 190 and then around groove 122*b* of the lift vertical directional sheave 122, and routed back to the opposite end of the lifting rail (not shown). With further reference to FIG. 21, the lift cable 210 is routed around a lift vertical directional sheave 110 at the opposite end of the lift rail where it is routed downward to terminate at lift bar 260.

Figure 25:
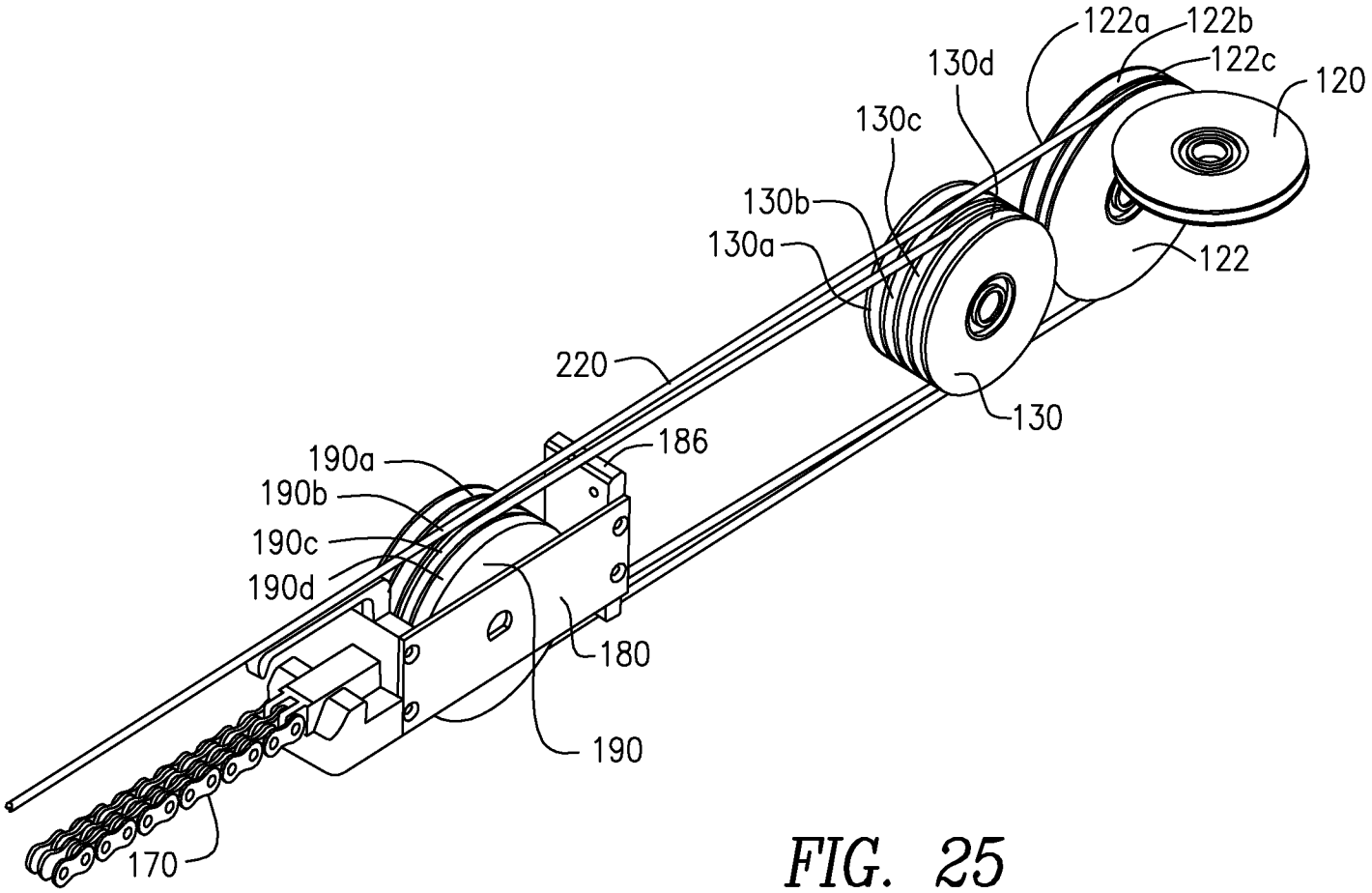
FIG. 25 is an elevated perspective view of a lifting block and a third lift cable arranged on sheaves in accordance with an embodiment of the present disclosure.

Now referring to FIG. 25, lift cable 220 is fixed to a bottom portion of rear end 186 of the lift block 180 such as by routing through a hole in the bottom of the rear end 186 of the lift block 180 and held in place by a button (not shown) swaged on the end of the cable 220. Lift cable 220 is then routed around groove 130*c* of the ratio multiplication sheave 130, back to and around groove 190*c* of the lift block sheave 190 and then around groove 122*c* of lift vertical direction sheave 122, and then routed back to the opposite end of the lifting rail (not shown), where, with further reference to FIG. 21, the lift cable 220 is routed around a horizontal directional sheave 112, and then routed across the width of the trolley to the opposite rail, i.e., the slide rail (not shown), over a vertical directional sheave 114 mounted proximate an end of the slide rail, and downward to terminate at a lift bar 260.

Figure 26:
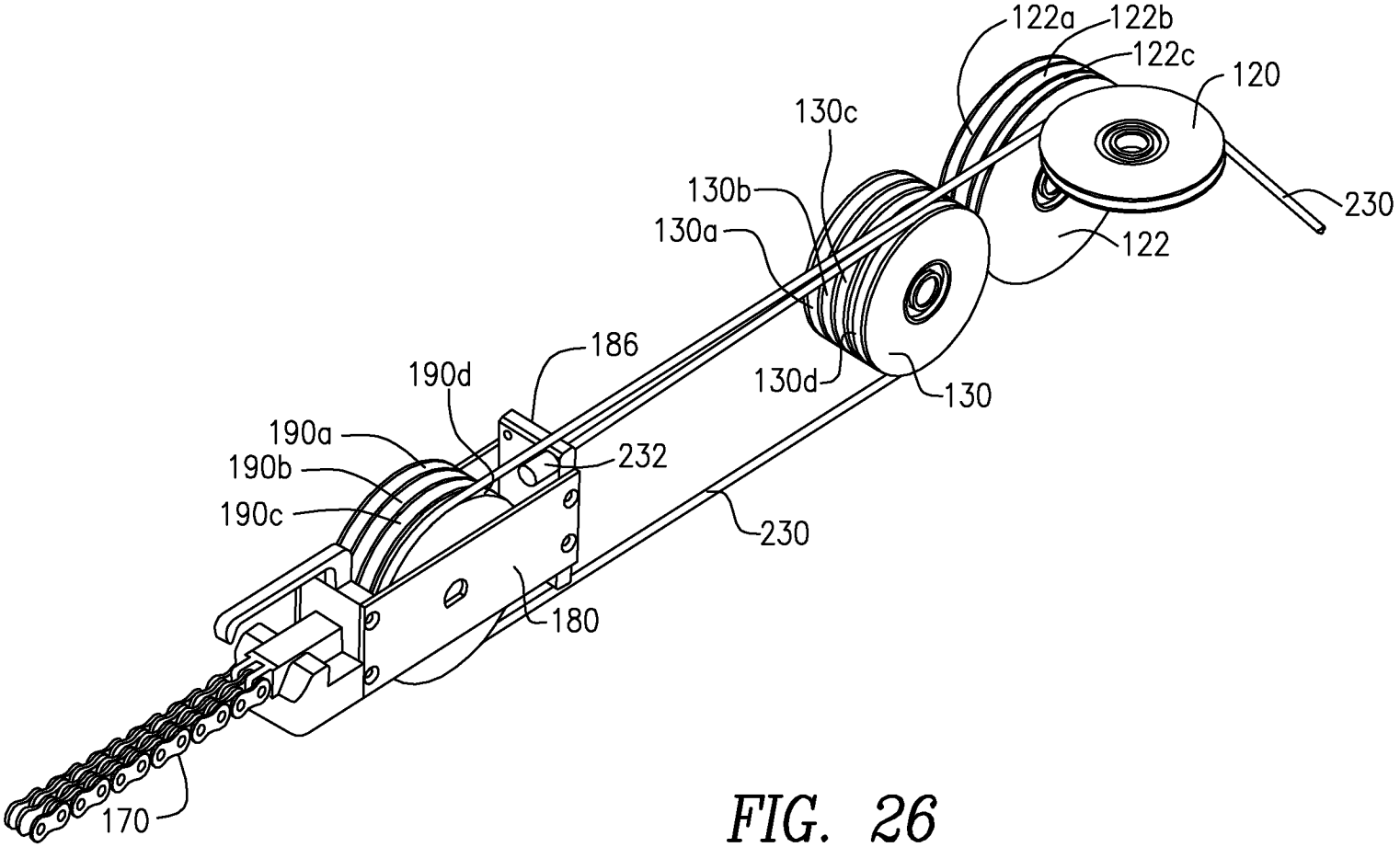
FIG. 26 is an elevated perspective view of a lifting block and a fourth lift cable arranged on sheaves in accordance with an embodiment of the present disclosure.

Now referring to FIG. 26, lift cable 230 is fixed to a top portion of the rear end 186 of the lift block 180 such as by mounting an end thereof through an opening in the rear end 186 of the lift block 180 and held in place by a button 232 swaged on the end of the cable 230. It is then routed around groove 130*d* of the ratio multiplication sheave 130, back to and around groove 190*d* of the lift block sheave 190 and then around a lift horizontal directional sheave 120 where it is routed across the width of the trolley (not shown) to the opposite rail, i.e., the sliding rail shown), where, with further reference to FIG. 21, the lift cable 230 is routed downward over a vertical directional sheave 124 mounted proximate an end of the sliding rail to terminate at lift bar 260.

Cables may be but are not limited to ropes, belts, chains, cables or the like, made of suitable materials such as metal, Kevlar, polymer, reinforced polymer, hemp, etc. In sheaves which accommodate more than one cable, the sheaves may comprise a unitary element with multiple grooves, or may be individual pulleys which are independently rotatable. For example, sheave 58 comprises independent rotatable pulleys. Sheaves 122, 130 and 190 may likewise comprise independently rotatable pulleys.

Controls

Control systems well known to those skilled in the art may be used in connection with the embodiments disclosed herein. For example, and not by way of limitation, in one or more embodiments the lifting cylinder 78 has two hoses or tubes that are coupled to a hydraulic control block mounted to the trolley. The slide cylinders 52 and 53 may likewise each have two hoses or tubes from coupled to the same control block. The control block may include a plurality of cartridge valves or directional control valves to control the cylinders. The valves may be actuated by a programmable controller that is operator controllable. Hydraulic pressure and return lines may couple the control block through flexible hoses to a hydraulic power unit. Electrical lines may be routed from the PLC to the control block via the two hoses used to control the valves.

Platform

The platform 300 may be any suitable platform for a lift and slide-type parking system. In one or more embodiments the platform includes a drive on ramp, wheel stop and wheel runways extending therebetween. In one embodiment the drive-on ramp is disposed at either end of the ramp and may have sloped front and back ends so that as a car is driven onto the platform and onto the runway treads the sloped back end serves as a block to prevent the car rolling off the end of the platform. A wheel stop may be employed at one platform end opposite the entrance end and is dimensioned to prevent a vehicle from rolling off that end of the platform. The lifting bars 260 may be connected to the outside ends of the drive on ramp or wheel stop. The platform may have drive-on ramps at opposite ends to permit cars to enter or exit either end.

The thickness of the platform may be any suitable thickness. In some embodiments the thickness is from about 3 mm to about 10 mm. Employing a minimal platform thickness, such as 2 mm, with the wheels resting on the very bottom of the platform, permits a reduction of space between the raised platform and a car parked beneath the platform. In some embodiments the platform has a flat top and bottom surface, for example, with a rectangular or square cross section. This is in contrast to some existing platform floor designs, in which the surface of the platform upon which the wheels of an automobile are designed to rest (sometimes referred to as the runway or rolling surface) is made from a corrugated sheet rather than a flat sheet, and/or other support or lifting members are installed below the platform floor so that the distance from the surface of the platform upon which the wheels rest to the surface that would touch the floor when the platform is lowered, i.e., the effective thickness of the platform, may be as much as 2 inches, or 50 mm. Furthermore, some existing lift platforms include a box constructed of tubular steel members with braces running longitudinally and laterally which requires the rolling surface to be positioned on top of the frame. This type of platform could be as much as 4 inches or about 100 mm thick.

Embodiments disclosed herein save space by storing cars in a smaller footprint. This is achieved due to several unique features. The lift and slide rails 41, 42 can be placed directly over the rearview mirrors of a car when the car is in the stored position on the trolley. The platform 300 includes lifting bars 260 which are raised into stabilizing tubes 62 that keep the platform 300 from swinging when the trolley 30 is moved from side to side. The systems and trolleys disclosed herein eliminate the need for electric motors or other mechanical devices installed over the side-to-side connecting rails, which eliminates wasted space as seen in conventional systems. The diagonal tensioning cables 60 used to keep the trolley 30 square also serve as a safety measure to stop vehicles above from lowering inadvertently. Systems described herein use hydraulic cylinders to operate so the speed of the system can be increased simply by adjusting the flow rate to the cylinders. There is no need to add larger drive units which occupy more space. The described invention increase the amount of lift available by positioning the lift cylinder below the lifting block, allowing the lifting block to move a much further distance thus increasing the lift. The novel arrangement of lifting cables and sheaves allow the lifting rail to be made much smaller, permitting its placement just above the rearview mirrors of the stored vehicles. Embodiments herein include a safety latch which is automatically released by the lift block so no electrical or mechanical latch release mechanism is required. The horizontal movement of the system is done with specially configured slide hydraulic cylinder and cable arrangements.

Although the devices and systems of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and methods may be made without departing from the spirit or scope of the present disclosure. Accordingly, such changes, modifications, enhancements and/or refinements are encompassed within the scope of the present invention.

What is claimed is:

1. A trolley for a lift-slide parking system, the trolley comprising a rectangular frame and a rectangular platform depending from the frame, wherein the frame comprises a first side comprising a lift rail comprising a platform lifting apparatus, a second, opposite side comprising a slide rail comprising a trolley sliding apparatus, and first and second ends disposed between the first side and opposite side, and further comprising at least one roller extending from each of the first and second end of the frame and oriented in axial alignment with the first and second ends of the frame, wherein the rollers at each end of the trolley are sized and configured to engage respective tracks oriented in axial alignment with the first and second ends of the frame, wherein the tracks are fixed to a superstructure of a lift-slide parking system, wherein the platform lifting apparatus comprises a lift hydraulic cylinder coupled to the lift rail disposed in axial alignment with the first side coupled to a cylinder block comprising a cylinder block sheave slidably disposed in a cylinder block channel formed in the lift rail in axial alignment with the cylinder, wherein the cylinder block is coupled via a belt to a first end of a lifting block slidably disposed in a lifting block channel formed in the lift rail side and axially aligned with and above the cylinder block channel, wherein the belt is routed over at least one roller positioned in a first corner of the frame in axial alignment with the lift rail, wherein the belt is anchored to the frame proximal the first corner and routed around the cylinder block sheave, wherein the lifting block comprises a plurality of lift cables extending from a second end thereof, wherein each of the plurality of cables extend and are coupled to respective lift bars coupled to respective corners of the platform; and wherein the trolley sliding apparatus comprises at least two slide hydraulic cylinders coupled to the slide rail and disposed in axial alignment with the second side of the frame, wherein a first of the slide hydraulic cylinders is coupled to a first slide cable, wherein the first slide cable is anchored at a first end to the frame and couplable at a second end to one of the tracks at a first position, and a second of the slide hydraulic cylinders is coupled to a second slide cable, wherein the second slide cable is anchored at a first end to the frame and couplable at a second end to the same track as the first slide cable at a second position wherein when the first and second slide cables are coupled to the track, wherein actuation of one of the slide hydraulic cylinders is operable to pull the slide cable coupled thereto causing the trolley to move in a first direction in axial alignment with the track, and actuation of the other of the slide hydraulic cylinders is operable to pull the slide cable coupled thereto causing the trolley to move in a second, opposite direction.

2. The trolley according to claim 1 wherein the lift block comprises a lift block sheave.

3. The trolley according to claim 2 comprising a ratio multiplication sheave axially aligned with the lift rail proximal a second corner positioned opposite the first corner of the frame.

4. The trolley according to claim 3 wherein a first of the plurality of lift cables is routed from the lift block around the ratio multiplication sheave, back to and around the lift block sheave and over a first lift vertical directional sheave positioned proximate the ratio multiplication sheave, and routed downward to terminate at a first of the respective lift bars.

5. The trolley according to claim 3 wherein a second of the plurality of lift cables is routed from the lift block around the ratio multiplication sheave, back to and around the lift block sheave, then around a second lift vertical directional sheave positioned proximate the ratio multiplication sheave, and routed back to and over a lift vertical directional sheave positioned proximate the second corner and routed downward to terminate at a second of the respective lift bars.

6. The trolley according to claim 5 wherein the second vertical directional sheave is mounted in axial alignment with the first vertical direction sheave.

7. The trolley according to claim 3 wherein a third of the plurality of lift cables is routed from the lift block around the ratio multiplication sheave, back to and around the lift block sheave and around a first lift vertical directional sheave positioned proximate to and in axial alignment with the ratio multiplication sheave, and routed along the lift rail to and around a first lift horizontal directional sheave positioned proximate the second corner, and routed over a third vertical directional sheave mounted proximate a third corner of the frame diagonally opposite the first corner and routed downward to terminate at a third of the plurality of lift bars.

8. The trolley according to claim 3 wherein a fourth of the plurality of lift cables is routed from the lift block around the ratio multiplication sheave, back to and around the lift block sheave and around a second lift horizontal directional sheave positioned proximate the first corner, then routed over a fourth vertical directional sheave mounted proximate a fourth corner of the frame diagonally opposite the second corner and routed downward to terminate at a fourth of the plurality of lift bars.

9. The trolley according to claim 1 wherein the distance from a floor of the platform to a bottom side of the lift rail when the platform is in a fully raised position is adequate to permit passage of a widest width of a vehicle parked on the platform.

10. The trolley according to claim 1 wherein the distance from a floor of the platform to a bottom side of the slide rail when the platform is in a fully raised position is adequate to permit passage of a widest width of a vehicle parked on the platform.

11. The trolley according to claim 1 further comprising a safety latch removably couplable to the lift block, wherein the safety latch is mounted proximal the at least one roller in the first corner of the frame.

12. The trolley according to claim 11, wherein the safety latch comprises a pawl operable to engage the first end of the lift block.

13. A lift-slide parking system comprising a plurality of trolleys positioned within a superstructure, the superstructure comprising a front side and a rear side and a plurality of tracks oriented horizontally on the front and rear side, each of the trolleys comprising a rectangular frame and a rectangular platform depending from the frame, wherein the frame comprises a first side comprising a lift rail comprising a platform lifting apparatus, a second, opposite side comprising a slide rail comprising a trolley sliding apparatus, and first and second ends disposed between the first side and opposite side, and further comprising at least one roller extending from each of the first and second end of the frame and oriented in axial alignment with the first and second ends of the frame, wherein the rollers at each end of the trolley are sized and configured to engage respective tracks oriented in axial alignment with the first and second ends of the frame, wherein the platform lifting apparatus comprises a lift hydraulic cylinder coupled to the lift rail disposed in axial alignment with the first side coupled to a cylinder block comprising a cylinder block sheave slidably disposed in a cylinder block channel formed in the lift rail in axial alignment with the cylinder, wherein the cylinder block is coupled via a belt to a first end of a lifting block slidably disposed in a lifting block channel formed in the lift rail side and axially aligned with and above the cylinder block channel, wherein the belt is routed over at least one roller positioned in a first corner of the frame in axial alignment with the lift rail, wherein the belt is anchored to the frame proximal the first corner and routed around the cylinder block sheave, wherein the lifting block comprises a plurality of lift cables extending from a second end thereof, wherein each of the plurality of cables extend and are coupled to respective lift bars coupled to respective corners of the platform; and wherein the trolley sliding apparatus comprises at least two slide hydraulic cylinders coupled to the slide rail and disposed in axial alignment with the second side of the frame, wherein a first of the slide hydraulic cylinders is coupled to a first slide cable, wherein the first slide cable is anchored at a first end to the frame and coupled at a second end to one of the tracks at a first position, and a second of the slide hydraulic cylinders is coupled to a second slide cable, wherein the second slide cable is anchored at a first end to the frame and coupled at a second end to the same track as the first slide cable at a second position, wherein actuation of one of the slide hydraulic cylinders is operable to pull the slide cable coupled thereto causing the trolley to move in a first direction in axial alignment with the track, and actuation of the other of the slide hydraulic cylinders is operable to pull the slide cable coupled thereto causing the trolley to move in a second, opposite direction.

14. The system according to claim 13 wherein the lift block comprises a lift block sheave.

15. The system according to claim 14 comprising a ratio multiplication sheave axially aligned with the lift rail proximal a second corner positioned opposite the first corner of the frame.

16. The system according to claim 15 wherein a first of the plurality of lift cables is routed from the lift block around the ratio multiplication sheave, back to and around the lift block sheave and over a first lift vertical directional sheave positioned proximate the ratio multiplication sheave, and routed downward to terminate at a first of the respective lift bars.

17. The system according to claim 15 wherein a second of the plurality of lift cables is routed from the lift block around the ratio multiplication sheave, back to and around the lift block sheave, then around a second lift vertical directional sheave positioned proximate the ratio multiplication sheave, and routed back to and over a lift vertical directional sheave positioned proximate the second corner and routed downward to terminate at a second of the respective lift bars.

18. The system according to claim 17 wherein the second vertical directional sheave is mounted in axial alignment with the first vertical direction sheave.

19. The system according to claim 15 wherein a third of the plurality of lift cables is routed from the lift block around the ratio multiplication sheave, back to and around the lift block sheave and around a first lift vertical directional sheave positioned proximate to and in axial alignment with the ratio multiplication sheave, and routed along the lift rail to and around a first lift horizontal directional sheave positioned proximate the second corner, and routed over a third vertical directional sheave mounted proximate a third corner of the frame diagonally opposite the first corner and routed downward to terminate at a third of the plurality of lift bars.

20. The system according to claim 15 wherein a fourth of the plurality of lift cables is routed from the lift block around the ratio multiplication sheave, back to and around the lift block sheave and around a second lift horizontal directional sheave positioned proximate the first corner, then routed over a fourth vertical directional sheave mounted proximate a fourth corner of the frame diagonally opposite the second corner and routed downward to terminate at a fourth of the plurality of lift bars.

* * * * *